US008764471B2

(12) United States Patent
Dang

(10) Patent No.: US 8,764,471 B2
(45) Date of Patent: Jul. 1, 2014

(54) ELECTRICAL CONNECTOR FOR HIGH-SPEED DATA TRANSMISSION

(75) Inventor: Phong Dang, Kent, WA (US)

(73) Assignee: Carlisle Interconnect Technologies, Inc., Kent, WA (US)

( * ) Notice: Subject to any disclaimer, the term of this patent is extended or adjusted under 35 U.S.C. 154(b) by 63 days.

(21) Appl. No.: 13/314,174

(22) Filed: Dec. 7, 2011

(65) Prior Publication Data

US 2012/0171884 A1 Jul. 5, 2012

Related U.S. Application Data

(60) Provisional application No. 61/420,722, filed on Dec. 7, 2010, provisional application No. 61/532,436, filed on Sep. 8, 2011.

(51) Int. Cl.
*H01R 13/62* (2006.01)

(52) U.S. Cl.
USPC ..... 439/310

(58) Field of Classification Search
USPC ..... 439/310, 607.27, 95–110, 941, 439/607.01–607.04, 441
See application file for complete search history.

(56) References Cited

U.S. PATENT DOCUMENTS

| | | | | |
|---|---|---|---|---|
| 4,191,443 | A | 3/1980 | Doyle | |
| 4,261,633 | A * | 4/1981 | Abernethy | 439/406 |
| 5,797,770 | A * | 8/1998 | Davis et al. | 439/607.27 |
| 6,077,122 | A | 6/2000 | Elkhatib et al. | |
| 6,190,202 | B1 | 2/2001 | Lai | |
| 6,244,892 | B1 | 6/2001 | McCarthy | |
| 6,328,601 | B1 * | 12/2001 | Yip et al. | 439/607.08 |
| 6,544,067 | B2 | 4/2003 | Hagmann | |
| 6,893,296 | B2 | 5/2005 | Aekins et al. | |
| 7,153,168 | B2 | 12/2006 | Caveney et al. | |
| 7,172,466 | B2 | 2/2007 | Aekins et al. | |
| 7,195,518 | B2 * | 3/2007 | Bert et al. | 439/607.43 |
| 7,255,613 | B2 | 8/2007 | Mackey et al. | |
| 7,316,584 | B2 | 1/2008 | Mackillop et al. | |

(Continued)

FOREIGN PATENT DOCUMENTS

| | | | |
|---|---|---|---|
| EP | 2 355 258 | A1 | 2/2011 |
| FR | 2 805 932 | A1 | 3/2000 |
| WO | WO 2010/115514 | A2 | 10/2010 |

OTHER PUBLICATIONS

International Electrotechnical Commission, Publicly Available Specification IEC/PAS 61076-2-109 (Pre-Standard), Edition 1.0, dated Mar. 2010, 8 pages.
Siemon, Network Cabling Solutions, Siemon Z-MAX Category 6A Structured Cabling System, http://www.siemon.com/us/zMAX, visited Dec. 5, 2011, 8 pages.
Siemon, Network Cabling Solutions, Siemon's Z-MAX Structured Cabling Solution: Reinventing the RJ-45 for Tomorrow's Network, Feb. 2009, 12 pages.

(Continued)

*Primary Examiner* — Jean F Duverne
(74) *Attorney, Agent, or Firm* — Stoel Rives LLP

(57) ABSTRACT

An electrical connector system includes a pin connector and a socket connector that each attach to a cable having multiple twisted pairs of wires. The connectors include features for shielding each pair of pin or socket contacts from the other pairs of pin or socket contacts to reduce interference and crosstalk. A contact-retaining shell of one of the connectors includes an integrally formed insertion plug having cantilever elements that electrically contact a conductive surface of the mating connector to provide a low-impedance pathway between the shell and the mating connector for purposes of grounding and/or shielding. The electrical connector system is designed to be readily disassembled and reassembled for repair or re-work without the use of special tools.

38 Claims, 27 Drawing Sheets

(56) References Cited

U.S. PATENT DOCUMENTS

| | | | |
|---|---|---|---|
| 7,736,159 | B1 | 6/2010 | Effinger, III et al. |
| 2003/0096529 | A1 | 5/2003 | Brennan et al. |
| 2004/0157493 | A1 | 8/2004 | Bergner et al. |
| 2008/0096433 | A1 | 4/2008 | Bixler et al. |
| 2009/0104819 | A1 | 4/2009 | Hermant et al. |
| 2010/0048061 | A1 | 2/2010 | Helmig et al. |

OTHER PUBLICATIONS

Yoshitake, James, Interconnect Solutions for Aircraft Ethernet Data Networks, Defense Electronics Magazine, Oct. 2007, pp. 14-17, Penton Media, Inc.

Phoenix Contact, Assembly Instructions, VS-08-M12MS-10G-P SCO and VS-08-M12MR-10G-P SCO, dated Mar. 2010, 1 page.

* cited by examiner

ELECTRICAL CONNECTOR FOR HIGH-SPEED DATA TRANSMISSION

RELATED APPLICATIONS

This application claims the benefit under 35 U.S.C. §119 (e) from U.S. Provisional Application Nos. 61/420,722, filed Dec. 7, 2010, and 61/532,436, filed Sep. 8, 2011, both titled "Connector For High-Speed Data Transmission," and both incorporated herein by reference.

TECHNICAL FIELD

The field of this disclosure relates to electrical connectors and, in particular, to cable-terminating electrical connector system having enhanced shielding to reduce interference and crosstalk amongst different wires of the cable and different conductors of the connector system.

BACKGROUND

Increasingly, electronic devices transmit and receive high-frequency electrical signals representing digital data. High-speed data transmission, such as so-called Ultra High-Speed (UHS) data transmission involves the transmission of data between electronic devices at rates of 1 to 10 gigabits per second using signal frequencies of 100 MHz to 500 MHz. There is a desire for future high-speed data transmission at even faster rates and at even higher frequencies. For example, UHS data transmission may be achieved over 1000BASE-T Ethernet networks using category 5, 5E, 6 or 6A cables. Such high-speed digital data networks are not confined to terrestrial applications, especially as high-speed electronics are developed for aerospace and other suitable applications.

High-speed digital data transmission is facilitated by a data transmission system with a relatively high signal to noise ratio. One exemplary system includes a 1000BASE-T Ethernet network that includes category 5, 5E, 6 or 6A cables. Cables in such a system are designed to propagate data signals without generating or introducing appreciable noise, and are terminated by electrical connectors at either end to either connect cables together, or to connect cables to electronic devices. Electrical connectors commonly used for terrestrial applications, such as an RJ-45 style connector, have proved to be less than suitable for aerospace and other applications. In aerospace and other applications, electrical connectors are subjected to a variety of harsh environmental conditions, such as the presence of moisture, vibrations and mechanical shock, relatively high amounts of external electrical and magnetic interference, and pressure changes, all of which can detrimentally affect an electrical connector's performance, that is, its ability to transmit data signals while maintaining a relatively high signal to noise ratio. Common electrical connectors for aerospace and other suitable applications, such as the Quadrax-style connector, tend to work well for data transfer rates less than 1 gigabit per second, but tend to exhibit, induce, generate or introduce excessive noise during high-speed data transmission at rates faster than 1 gigabit per second.

U.S. Pat. No. 7,316,584 describes an electrical connector designed to reduce crosstalk. Electrical connectors described in the '584 patent include an electrically conductive "X"-shaped grounding post 32 (best seen in FIGS. 3A and 3B thereof) in an attempt to electrically isolate each of four pairs of contacts from the other three pairs of contacts by placing each pair between two adjacent arms of the "X". Devices in the '584 patent also include a follower 42 that is located behind the "X"-shaped grounding post such that each pair of wires corresponding to a pair of contacts traverses through one of four apertures in the follower. The follower may be made from an electrically conductive material to provide electrical isolation between each wire pair. The '584 patent also discloses that each pair of wires "become untwisted in the region of the follower 42."

Because degraded performance of an electrical connector adversely affects the ability of a system to transfer data at high rates, the present inventor has recognized a need for a robust electrical connector capable of facilitating high-speed data transfer in aerospace and other suitable applications, for example, in aircraft electronic systems having performance criteria meeting gigabit data transfer standards such as 1000BASE-T.

The present inventor has thus identified a need for an improved connector configuration for reducing crosstalk, noise, and interference in high-speed data transmission systems and for such connectors having enhanced reliability in demanding environments.

SUMMARY

An electrical connector system includes a pin connector and a mating socket connector. In one arrangement, each of the connectors is attached to a cable having four twisted pairs of wires. The connectors preferably include features for shielding each of several pairs of wire-terminating contacts of the connector from the other pairs contacts to thereby reduce interference and crosstalk. In one aspect, an electrically conductive front shell of the connector defines a plurality of contact-receiving cavities extending in an axial direction and having openings at a front face of the front shell. An electrically conductive insertion plug portion of the front shell projects from the front face in the axial direction from a location on the front face between the openings for insertion into a connection bore of the mating connector. The insertion plug portion includes multiple cantilever members each including a radially outwardly projecting portion located proximate a free end of the cantilever member for pressing against an inner surface of the connection bore to establish a low-impedance electrical coupling between the shells of the connector and the mating connector. The insertion plug portion and the cantilever members may be integrally formed with the front face of the front shell. In some embodiments, the cantilever members cooperate with a connecting post slidably mounted in the front shell to provide a latching function.

In another aspect, a connector system includes a first connector with an electrically conductive front shell having an insertion plug portion projecting from the front face of the front shell in an axial direction, and a second connector that is configured to be slidably mated to the first connector along a connection axis. The second connector includes a conductive front shell defining a connection bore sized to receive the insertion plug portion of the first connector so that at least one of the radially outwardly projecting portions of the cantilever members of the insertion plug bears upon a conductive inner surface of the connection bore when the connector and mating connector are mated, to thereby establish a low impedance connection between the front shell of the connector and the front shell of the mating connector.

In yet another aspect, an electrical connector comprises an electrically conductive front shell in which is formed a plurality of contact-receiving cavities. The cavities extend in an axial direction entirely through the front shell to define a rear opening proximate a rear end of the front shell and an opposite front opening in a front face of the front shell. A conductive central core of the front shell extends in the axial direction and may slidably support a connecting post of a latch mechanism. A plurality of conductive fins radiate from the core and integrally interconnect the core with a peripheral portion of the front shell so that each fin separates and shields an adjacent pair of the cavities from each other. The peripheral portion, the core, and the fins are preferably all integrally formed in a monolithic structure.

Wire-terminating contacts are held in spaced-apart relation by a plurality of electrically insulating sheaths. Each sheath is sized to receive and retain a pair of the contacts such that at least a portion of each electrical contact is contained within the sheath in alignment with one of a pair of contact apertures in a front wall of the sheath, and so each of a pair of wires terminated by the electrical contacts extends through a rear end portion of the sheath. Each sheath is sized and shaped for insertion into one of the cavities in the front shell, preferably through the rear opening thereof, so as to position the contact apertures of the sheath in alignment with the front opening of the cavity.

An electrically conductive rear shell adapted to be coupled to the front shell and extends rearwardly of the rear end thereof so as to capture the insulating sheaths between the front and rear shells and retain them in the cavities. The rear shell may also hold a conductive shielding ferrule against the rear end of the front shell, for retaining the insulating sheaths and contacts in place. The shielding ferrule may include a flexible rear skirt that is flexed radially inwardly by the rear shell when the rear shell is coupled to the front shell, to thereby clamp onto the cable, such as onto a shielding layer wrapped around the wires of the cable.

In some embodiments, pin and socket contacts are inserted into and removed from the pin and socket connectors without requiring special tools other than tools commonly used to crimp or solder pin and socket contacts to wires, or to separate such contacts from wires.

Additional aspects and advantages will be apparent from the following detailed description of preferred embodiments, which proceeds with reference to the accompanying drawings.

DETAILED DESCRIPTION OF PREFERRED EMBODIMENTS

When forming an electrical connection between two cable segments it is important to match a particular twisted pair in one cable segment with a particular twisted pair in the other cable segment. Likewise, when forming an electrical connection between a cable and an electronic device it is important to match a particular wire pair with a particular terminal of the electronic device. In the embodiment illustrated in FIGS. 2, 4, and 40, matching a particular pair of wires in one cable to a particular pair of wires in another cable is facilitated by including indicia on the connectors near the apertures for holding contacts as described below. Such indicia may also be used to match a particular pair of wires with a particular terminal of an electronic device. Such matching helps ensure that signals are propagated between correct wire pairs and helps avoid splitting wire pairs, i.e., making one half of a correct connection and one half of an incorrect connection, which may induce crosstalk, such as near end crosstalk ("NEXT") or far end crosstalk ("FEXT").

Figure 2:
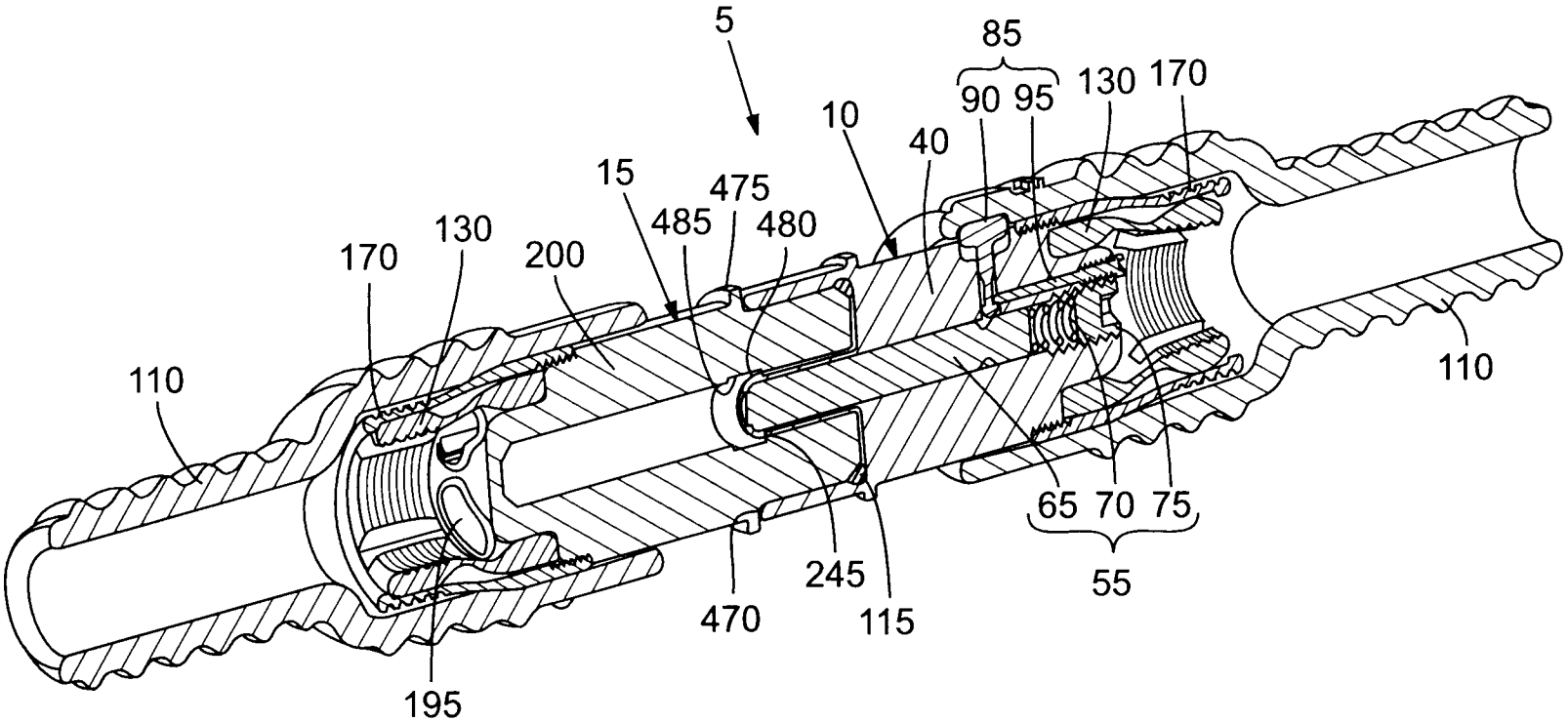
FIG. 2 is a left-side sectional isometric view of an electrical connector system including mating socket and pin connectors according to a first embodiment.
Figure 4:
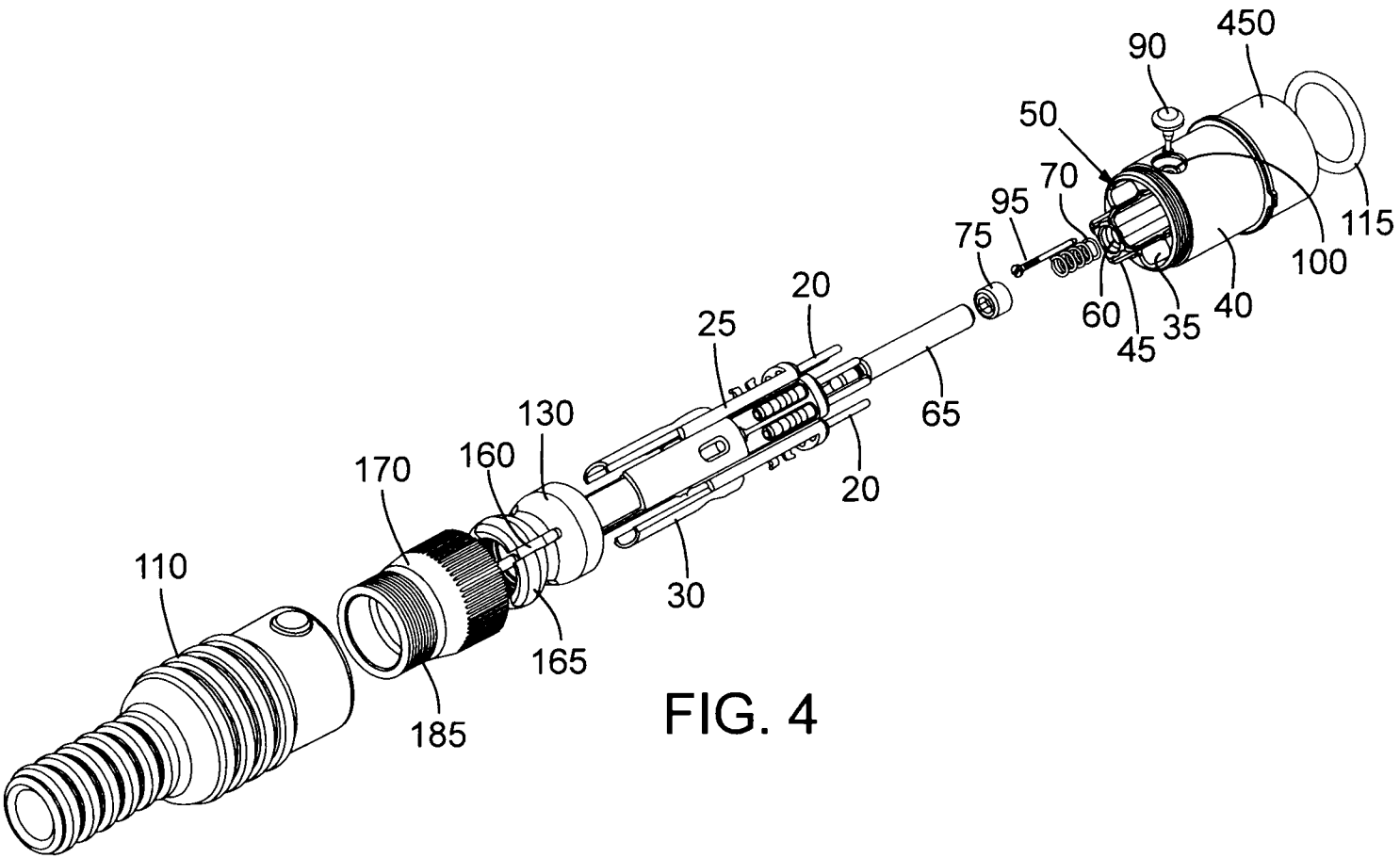
FIG. 4 is a right-side isometric partly exploded view of the pin connector of FIG. 2.
Figure 40:
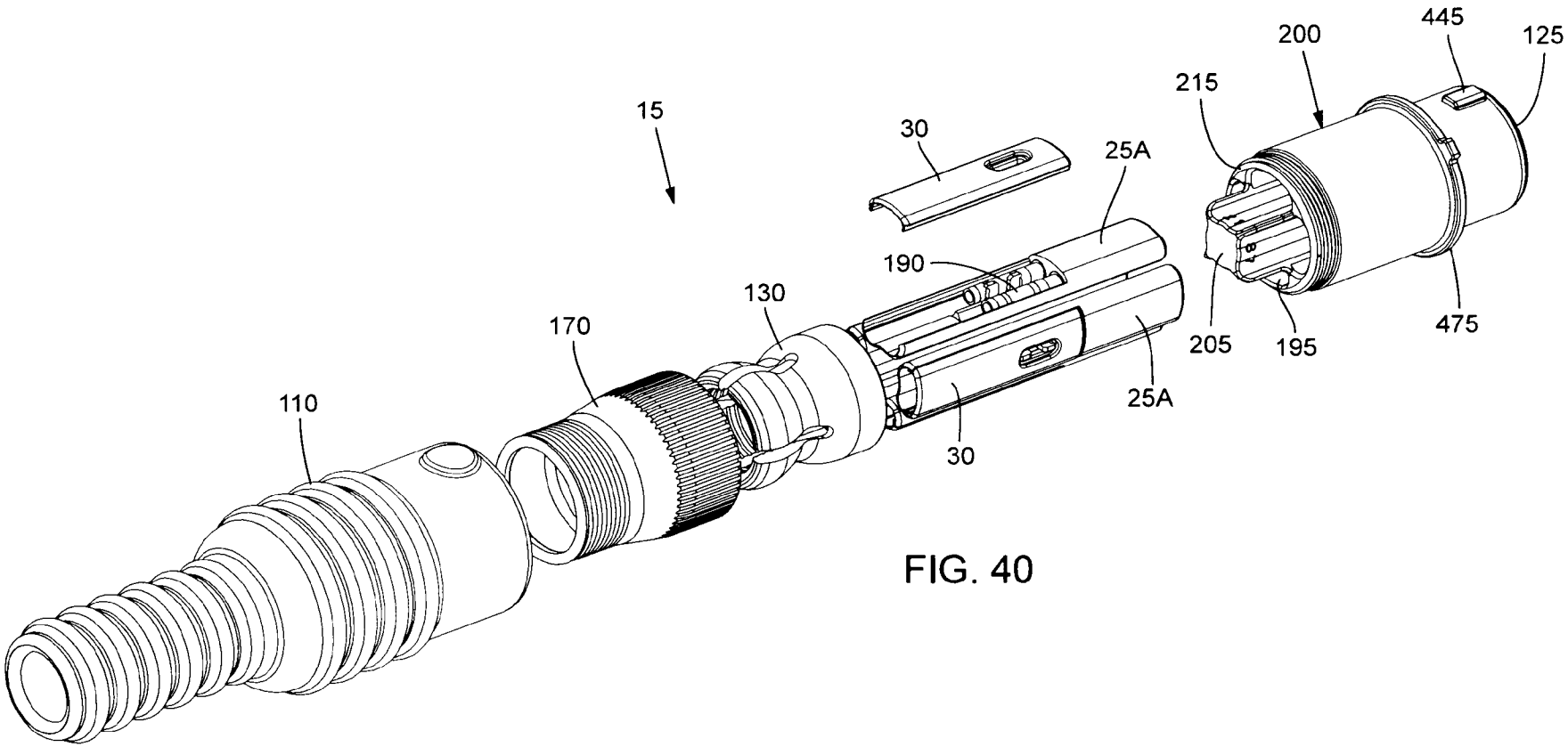
FIG. 40 is a partly exploded isometric view of the socket connector of FIG. 2.
Figure 41:
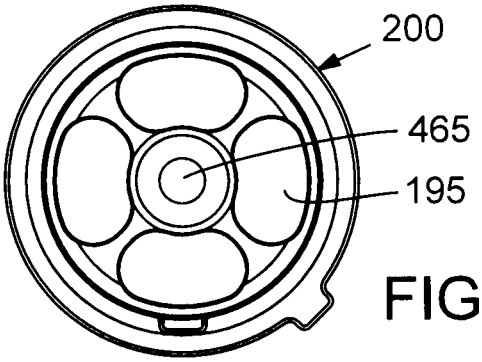
FIG. 41 is a front view of a conductive socket front shell of the connector of FIG. 40.

An embodiment of a connector system 5 is described with reference to FIGS. 2, 4, and 40. A description of the physical arrangement of components for the connector system 5 illustrated in FIGS. 2, 4, and 40 is followed by a description of a manner of assembling the parts for forming and connecting the electrical connector 5. Features of some of the components of the connector system 5 are then described with respect to using the connector system 5 to connect two cable segments together for high-speed data transfer, for example, data transferred at rates of 1 gigabit per second and faster by signals generated at frequencies ranging from approximately 100 MHz to approximately 600 MHz and faster. Although the invention is not so limited, the following discussions relate to forming an electrical connection between two cable segments that each include 4 pairs of twisted copper wires. Other exemplary uses include connecting a cable to a piece of electronic equipment and connecting cables with more or fewer than 4 pairs of twisted wire pairs, such as 2, 3, 5, 6, 7, or 8 pairs, for example.

Before discussing embodiments of electrical connectors that facilitate high-speed data transfer for systems located in relatively harsh environments, such as in aerospace applications, we begin with overview of two main mechanisms that can cause noise to be internally created within a cable - crosstalk and return loss. Crosstalk is primarily caused by unwanted electrical interference. Return loss is primarily caused by impedance mismatches. An overview is provided to better understand obstacles the present inventor has recognized that an electrical connector facilitating high-speed data transfer for systems located in relatively harsh environments should overcome.

Attenuation

A data signal, in other words, an electrical signal typically having a specific wave shape and height, must have sufficient energy to travel through a wire. Such energy is created at the near end of a wire when an electronic device creates an electrical pulse and transmits such electrical pulse to the wire. When an electrical pulse travels through a wire it loses energy, thus attenuating, in other words reducing, the energy of the electrical pulse as it moves through the wire. Such attenuation is frequency dependent. For typical cables or wires, electrical pulses transmitted as signals at relatively high frequencies, for example, high-speed data signals at 100 MHz to 500 MHz, are attenuated to a greater degree than are lower frequency signals, such that higher frequency signals are relatively weak by the time they reach the far end of a cable or wire compared to lower frequency signals. Attenuation may be influenced by the size of the electrical carrier (cross-sectional area), the length of the electrical carrier, and whether the electrical carrier makes a good electrical contact with other components such as contacts, for example.

Impedance

Impedance refers to the opposition to the flow of an electric pulse as it travels through a conductor, such as a wire. Impedance is also frequency dependent, but as the frequency increases, impedance decreases. For low frequency signals the impedance is largely a function of the conductor size, for example, a larger diameter wire has a lower impedance than does a smaller diameter wire. For high frequency signals, several physical aspects of a cable in addition to conductor size influence impedance, including the type of insulation material surrounding a wire, the thickness of such insulation, and the number of twists per inch for a twisted pair.

Cross Talk

Figure 1:
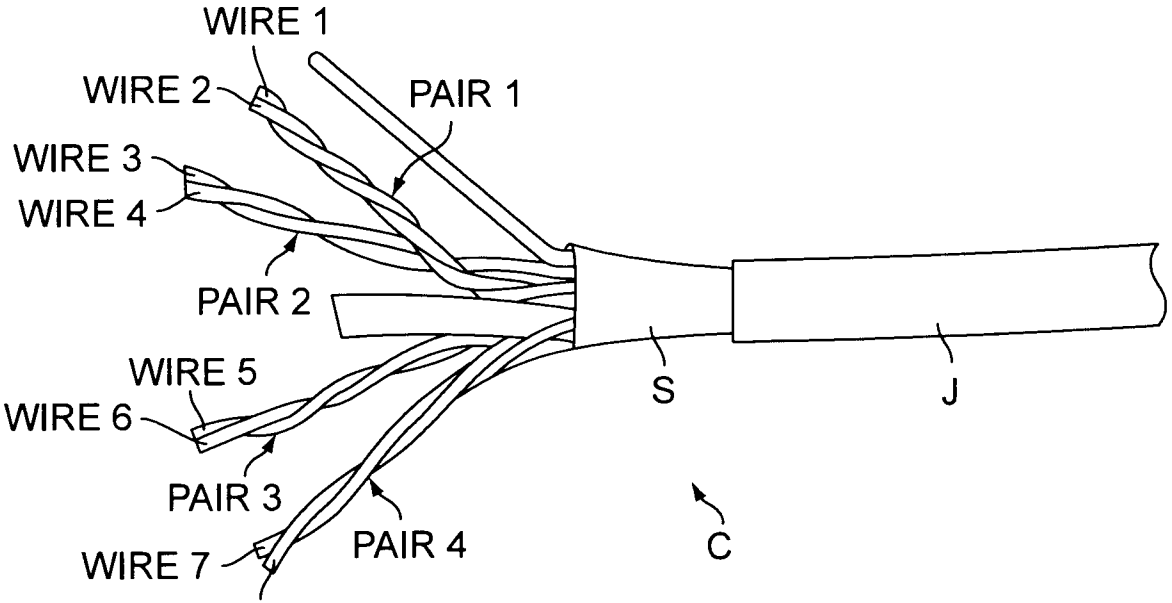
FIG. 1 shows an exemplary cable that includes four twisted pairs of wires.

As illustrated in FIG. 1, a category 5, 5E, 6, 6A (also known as Cat 5 (or Cat-5), Cat 5E, Cat 6, or Cat 6E) or other suitable cable "C" is commonly made from four twisted pairs of copper wires, PAIR 1, PAIR 2, PAIR 3, PAIR 4. Each wire, WIRE 1, WIRE 2, WIRE 3, WIRE 4, WIRE 5, WIRE 6, WIRE 7, WIRE 8 is covered with an electrically insulating material having a relatively uniform thickness. Thus, the insulating material on each of the wires keeps the two wires of each pair electrically isolated from each other and maintains a relatively uniform separation distance between the wires. Each of the twisted pairs (PAIR 1, PAIR 2, PAIR 3, and PAIR 4) commonly has a different twist rate, or pitch, that is, how many twists occur per unit of linear distance spanned by the pair. Cable C includes a foil shield "S" surrounding PAIR 1, PAIR 2, PAIR 3, and PAIR 4 to help prevent external electromagnetic interference from reaching PAIR 1, PAIR 2, PAIR 3, and PAIR 4 and to help prevent extraneous electrical signals from escaping cable C. A jacket "J" provides mechanical protection for shield S and the wires.

If the two insulated wires of each pair were to be untwisted, that is, laid together in a parallel manner with one side of each wire constantly facing the other, an electrical pulse, such as a data signal, travelling down one of the wires would create interference signals in the other wire through inductance and to a lesser degree through capacitance, largely depending on the separation distance between the wires. In other words, if the wires were spaced sufficiently far apart, an electric pulse travelling down one wire would not create interfering signals in the other wire. However, sufficiently separating such parallel wires often requires too much space to create compact cables.

Such interfering signals are referred to as crosstalk because, in essence, a signal from one wire crosses over to the other. The longer the distance two such wires are parallel to each other, and on the same side of each other, the larger such crosstalk signals may become. Since both wires commonly carry data signals at the same time for high-speed digital data transmission, a relatively large crosstalk signal may interfere with a data signal being carried by a wire and corrupt or overpower the data signal. To reduce crosstalk, instead of laying out a pair of wires in a parallel manner cable manufacturers twist such pairs of wires together, thus greatly shortening the distance over which any portions of the two wires are parallel and on the same side of each other. Any resulting crosstalk signals within the pair are thus kept relatively small and do not substantially interfere with a data signal being carried by either of the wires. Additionally, because each of the four twisted pairs has its own, unique twist rate, crosstalk signals between each of the four pairs is kept relatively small.

Untwisting an end portion of each twisted pair of a cable is necessary to connect each end of the cable to a connector for electrically connecting the cable to electronic devices or other cables. Each wire is terminated with a socket or pin contact which is then secured into an electrical connector. In the connector the contacts are typically arranged in a parallel fashion with respect to each other.

The present inventor has recognized that such untwisting of each wire pair and parallel arrangement of contacts may create substantially parallel sections of wires that provide an opportunity for crosstalk to be introduced at the ends of the cable (1) between wires of a twisted pair and (2) between each of the twisted pairs, especially over the length of the pin and socket contacts. When such crosstalk is introduced at the end of a cable where a data signal is generated, the crosstalk is referred to as near end crosstalk (NEXT). When such crosstalk is introduced at the end of a cable opposite where a data signal is generated, the crosstalk is referred to as far end crosstalk (FEXT). Thus, the present inventor has recognized that the untwisting of wires for attaching a cable to a connector may induce crosstalk signals in the cable when high-speed data signals are transmitted. The present inventor has also recognized that maintaining the twisted condition of each twisted pair to a point as close as possible to the pin and socket contacts may reduce the likelihood that crosstalk will be induced (1) between wires of a twisted pair and (2) between each twisted pair.

Return Loss

Return loss occurs when a portion of a data signal traveling through a conductor is reflected at the far end and propagated back through the conductor toward the near end where the data signal originated. The reflected portion of the data signal may interfere with a newly generated data signal thus corrupting the wave-shape or other characteristic of the data signal and interfering with the newly generated data signal's ability to convey data.

Signal reflections are typically created when a data signal encounters an impedance mismatch. For example, a characteristic impedance of a cable may have one value while the characteristic impedance of a connector may have a different value. When such an impedance mismatch between a cable and a terminating connector occurs, a portion of a data signal is reflected back down the cable.

The present inventor has recognized that the characteristic impedance of a cable carrying high-speed data signals is affected by several factors such as the wire diameter, the twist rate of each twisted pair, and the type and thickness of insulation surrounding each wire. The present inventor has also recognized that advantages resulting from matching the characteristic impedance of a cable to the characteristic impedance of a connector, such as reducing return loss, can be lost by (1) untwisting each of the twisted pairs of the cable when attaching the cable to the connector, (2) removing portions of the insulation coating from each wire, or (3) both, because such actions may change the characteristic impedance of the cable thus causing an impedance mismatch at the connector. Thus, the present inventor has recognized that untwisting each of the twisted pairs of the cable when attaching the cable to the connector, removing portions of the insulation from each wire, or both, may alter the characteristic impedance of the cable itself and cause an internal impedance mismatch. Such internal impedance mismatch within the cable itself may create return loss signals sufficient to interfere with newly generated data signals.

The present inventor has thus recognized that maintaining a cable's characteristic impedance is facilitated by maintaining the individual twist rate for each twisted pair as much as possible when a cable is terminated with an electrical connector. The present inventor has also recognized that maintaining a cable's characteristic impedance is facilitated by removing as little insulation from each wire as possible.

In addition to the above mentioned obstacles, the present inventor has recognized that common Quadrax-type connectors are not re-workable, that is, once a Quadrax-type connector is assembled the contacts cannot be removed without destroying the connector housing. For example, incorrectly loaded contacts cannot be removed and correctly loaded. The contacts in common Quadrax-type connectors also tend to be long and easily bent, and because common Quadrax-type connectors cannot be reworked such bent contacts typically require a new connector to replace the one with a bent contact.

The present inventor has also recognized a limitation of connectors that include an electrically conductive "X"-shaped grounding post between pairs of contacts, namely that there is a gap over each arm of the "X". As the number of data bits transferred per second increases the carrier frequencies also increase, which means the carrier wavelengths decrease. Such short wavelengths are capable of passing over the gap of each arm of the "X" shaped grounding post which reduces the effectiveness of such a grounding post at preventing cross talk, especially at relatively high data transfer rates.

Pin Connector Component Arrangement

Figure 56:
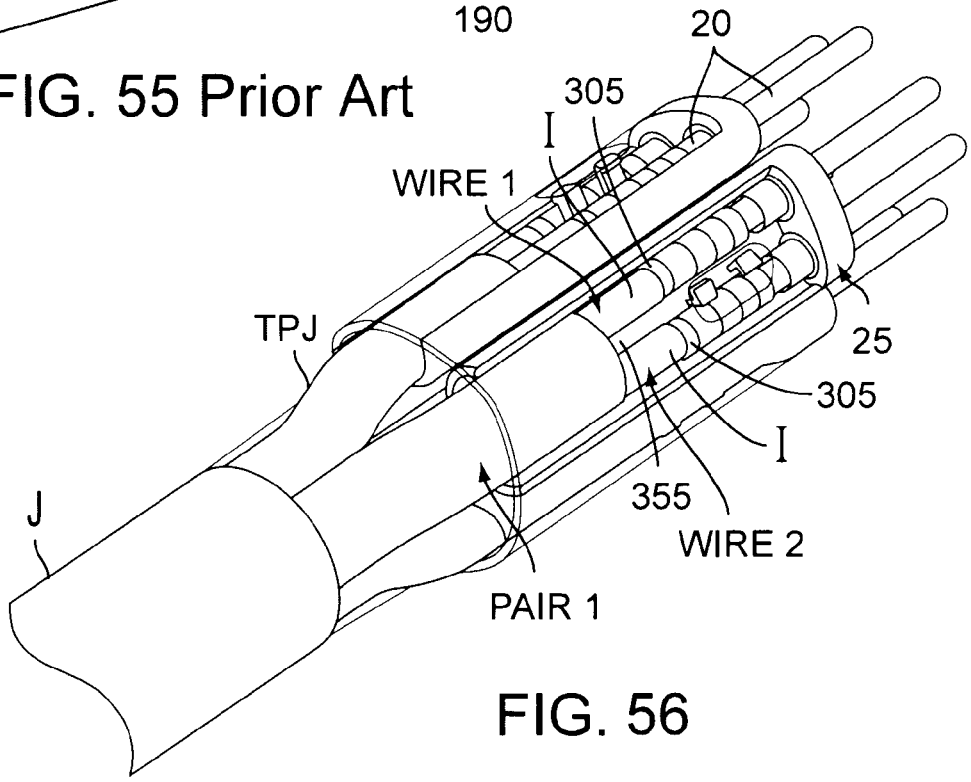
FIG. 56 illustrates a right-side rear isometric view of an exemplary arrangement of pin contacts located in sheaths as such sheaths would be arranged in a pin front shell and showing wire-termination detail.

With reference to FIG. 2, a connector system 5 according to an embodiment includes a pin connector 10 that mates and interfaces with a socket connector 15 to create an electrical connection between two cables (not illustrated for clarity). With reference to FIG. 4, pin connector 10 includes multiple pin contacts 20 that terminate four twisted wire pairs (FIG. 56). Each pair of pin contacts 20 terminating a corresponding pair of wires (e.g., WIRE 1 and WIRE 2 in FIG. 56) of a twisted pair (e.g. PAIR 1) are physically separated from each of the other three pairs of pin contacts 20 by placing each pair of pin contacts 20 in an electrically insulating sheath 25, or another sort of non-conductive contact housing. In one embodiment, each insulating sheath 25 is closed by a sliding, electrically insulating cover 30. In one arrangement, both the insulating sheaths 25 and covers 30 are molded or machined from a polymeric material, for example, fiber reinforced or unreinforced amorphous thermoplastic polyetherimide resin such as ULTEM® 1000, sold by Sabic Innovative Plastics IP B.V. Company of the Netherlands, or other suitable material. Additional details regarding insulating sheaths 25 are given below.

In another embodiment (not shown), there may be a single electrically non-conductive housing or sheath that includes multiple chambers, each enclosing a pair of contacts 20. In yet another exemplary embodiment, an electrically non-conductive housing or sheath may be configured to hold only a single contact.

Each insulating sheath 25, containing a pair of pin contacts 20 terminating the wires of a twisted pair and closed by a cover 30, is inserted into a cavity 35 in a pin front shell 40. Pin front shell 40 includes four cavities 35 extending in an axial direction entirely through pin front shell 40. Each cavity 35 has a rear opening proximate a rear end 50 of pin front shell 40 and an opposite front opening in a front face 43 of pin front shell 40. Pin front shell 40 includes a conductive central core member (post section 45) that extends in the axial direction, and four conductive fins 46 radiating from the core 45 and integrally interconnecting the core with a peripheral barrel portion of the pin front shell 40. Each of the fins 46 separates and shields adjacent ones of the cavities 35 from each other. Pin front shell 40 is made from an electrically conductive material, such as silver plated T6-7075 aluminum, for example. Other suitable materials, such as gold or nickel, can be used to plate pin front shell 40, and other suitable materials, such as other aluminum alloys, steel, copper or other suitable electrically conductive material, can be used to form pin front shell 40. In other embodiments, pin front shell 40 is made from an insulating material, such as polyetherimide or other suitable plastic, and is coated or plated with an electrically conductive material, such as silver, gold, or nickel. In a preferred embodiment, pin front shell 40 is machined from a single unitary block of metal, but other methods of integrally forming pin front shell 40 in a monolithic structure include molding, casting, metal injection molding (MIM), for example. Cavities 35 preferably have a curved cross-section in the shape of an arc segment of an annulus having curved or radiused ends that resembles a kidney bean shape or a bent obround shape. In one embodiment, each cavity 35 surrounds a substantial portion of each insulating sheath 25 when pin connector 10 is assembled. The conductive core or post section 45 extending from rear end 50 of pin front shell 40 may provide physical support for at least a portion of each insulating sheath 25. In other exemplary embodiments (not shown), the pin front shell may include cavities that extend for substantially the same length as each insulating sheath. When assembled, pin contacts 20 held by sheath 25 are positioned in alignment with the axial direction and extending through the front opening of the cavity 35 in front face 43.

Figure 10:
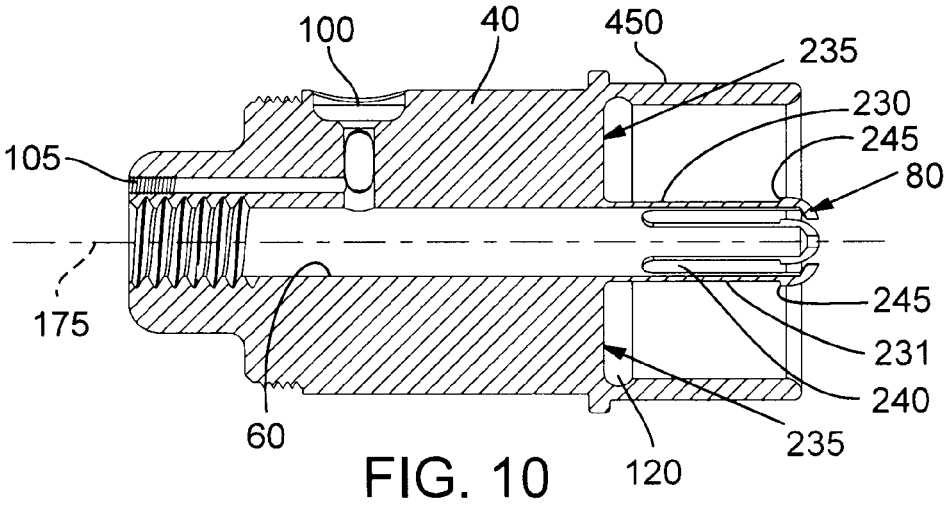
FIG. 10 is a right-side cross-section view of the pin front shell of FIG. 5.
Figure 12:
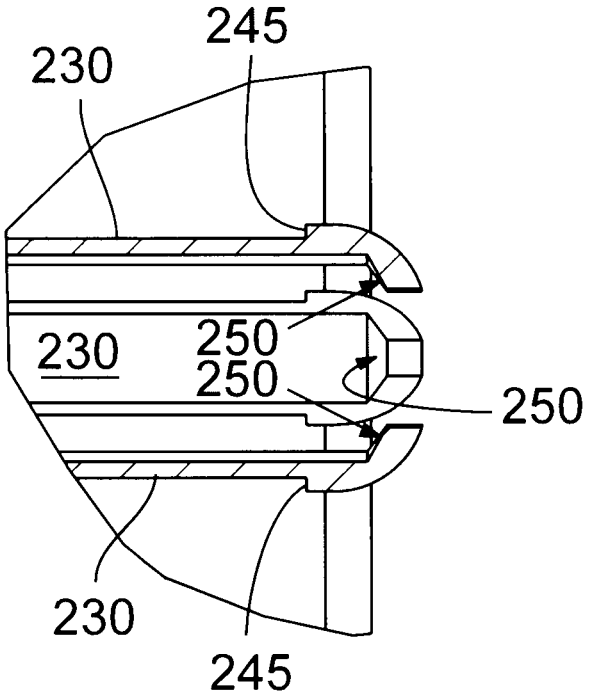
FIG. 12 is an enlarged right-side cross-section view of a front end portion of the pin front shell of FIG. 5.

With reference to FIGS. 2 and 4, an optional locking latch mechanism 55 includes a connecting post 65 slidably received in a locking bore 60 formed in core 45 and extending coaxially through pin front shell 40. A spring 70 is retained in the locking bore 60 by a set screw 75 and operably interposed between pin front shell 40 and connecting post 65 to urge connecting post 65 forwardly toward a front end of pin front shell 40. Connecting post 65 is preferably made from an electrically conductive material, such as T6-7075 aluminum that is plated with nickel, silver, or gold, for example, and is inserted in locking bore 60. As best illustrated in FIGS. 10 and 12, locking bore 60 is similar to a modified blind bore, that is, locking bore 60 is not open enough at a front end 80 to permit connecting post 65 to pass therethrough. The spring 70 and set screw 75 are inserted in a rear end of locking bore 60 to retain connecting post 65 within locking bore 60 and to urge connecting post 65 toward the front end 80 of the locking bore 60. Operation of the locking mechanism 55 is described in further detail below with reference to FIGS. 2, 10, and 12.

With reference to FIG. 2, an optional release mechanism 85 associated with locking mechanism 55 includes a release button 90 and pin 95. Release button 90 resides in a button aperture 100 formed in a sidewall of pin front shell 40 that communicates with locking bore 60. Operation of release mechanism 85 is described below with reference to FIGS. 2, 10, and 12. A rear seal, or boot, 110 covers release button 90 when pin connector 10 is assembled, to thereby inhibit moisture and other contaminants from entering pin front shell 40 through button aperture 90.

Figure 3:
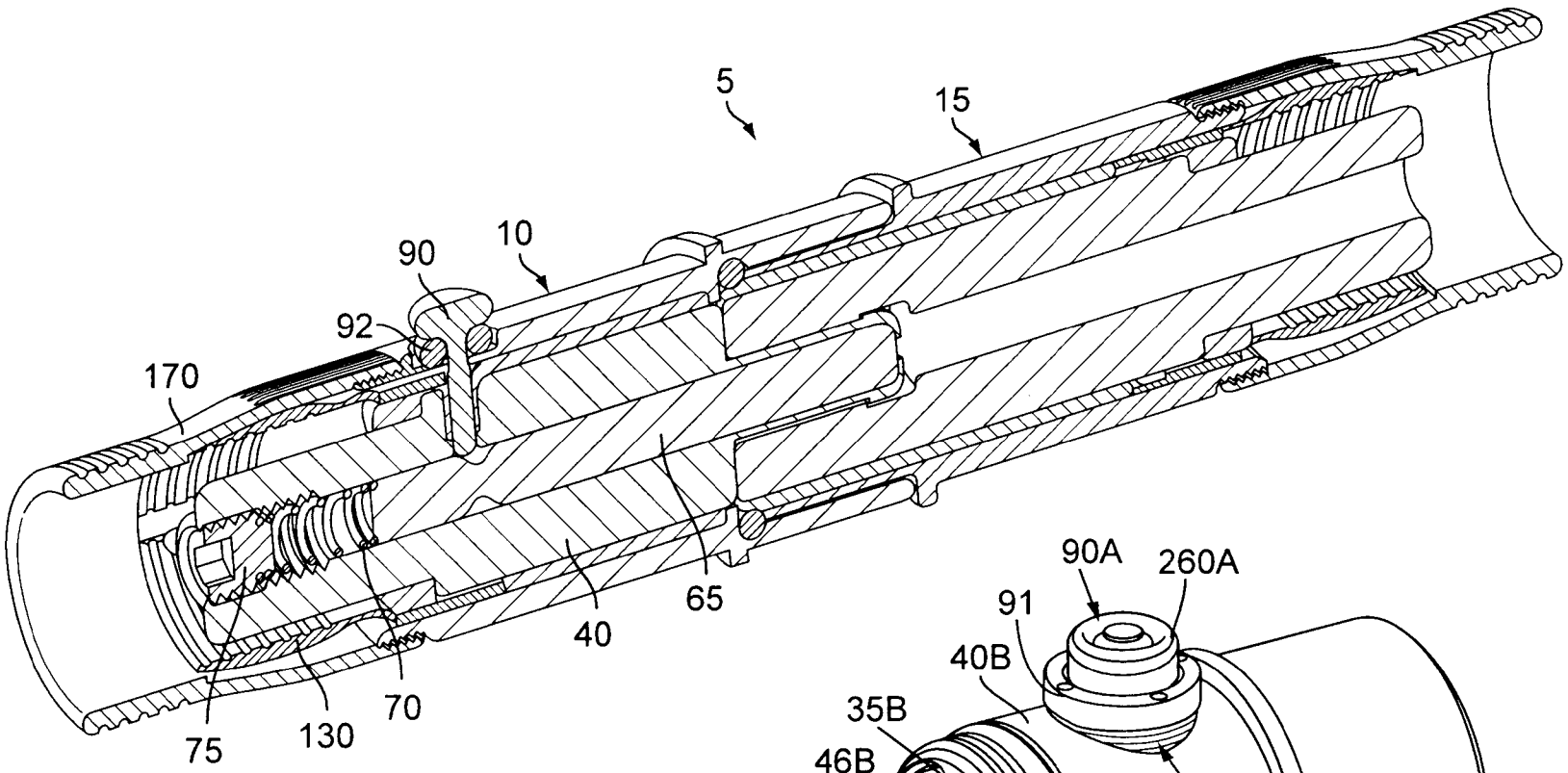
FIG. 3 is a sectional isometric view of an electrical connector system showing detail of a latch and a latch release mechanism according to a second embodiment.

In one embodiment illustrated in FIG. 3, a resilient sealing member such as an O-ring 92 may be included in button aperture 100 to form a moisture-resistant seal between button 90 and button aperture 100. O-ring 92, is also preferably sized and positioned to act as a biasing member that urges button 90 away from locking bore 60. In other exemplary embodiments, pin 95 may not be included to retain button 90 within button aperture 100. For example, release button 90 and button aperture 100 may include a detent mechanism, snap fit mechanism, or other suitable device, for retaining release button 90 within button aperture 100.

In other embodiments, a release mechanism includes a button aperture 100A (FIG. 3A) that is threaded into a radially outer surface of a peripheral barrel portion of pin front shell 40B. A circumferential sealing member (not illustrated), such as an O-ring, seats in the button aperture 100A such that a shaft of a release button 90A passes through the sealing member and a release button head 260A contacts an upper surface of the sealing member. An attachment device, such as threaded ring 91, contacts part of the release button head 260A and threads into the button aperture 100A to trap the release button 90A in the button aperture 100A. The threaded ring 91 also applies pressure to the release button head 260A to pinch the sealing member between the release button head 260A and a seat formed in the button aperture 100A in the pin front shell 40B. The sealing member thus inhibits moisture and other contaminants from entering the pin front shell 40B through the button aperture 100A. Preferably, the sealing member acts as a spring to urge the release button head 260A away from a locking bore, such as locking bore 60 (FIG. 10) in the pin front shell 40B.

With reference to FIGS. 2 and 4, a facial seal 115 is located in an internal groove 120 (FIG. 10) in pin front shell 40 and functions to hinder moisture, dust, or other contaminants from entering connector system 5 when the pin connector 10 and socket connector 15 are joined together. Facial seal 115 is made from a resilient material, for example, fluorosilicone having a hardness of approximately 45 Shore A to approximately 50 Shore A. Facial seal 115 may be a standard size O-ring. Facial seal 115 sits in internal groove 120, preferably without being glued or otherwise adhered in place. As described below, pin connector 10 and socket connector 15 are linearly joined together, that is, without imparting a twisting motion to either pin connector 10 or socket connector 15. Facial seal 115 is thus linearly compressed by a front face 125 (FIG. 40) of socket connector 15. In one embodiment, facial seal 115 has a thickness of approximately 0.040 inch and is locally compressed approximately 0.015 to approximately 0.020 inch to form a seal when pin connector portion 10 and socket connector portion 15 are joined together.

Figure 5:
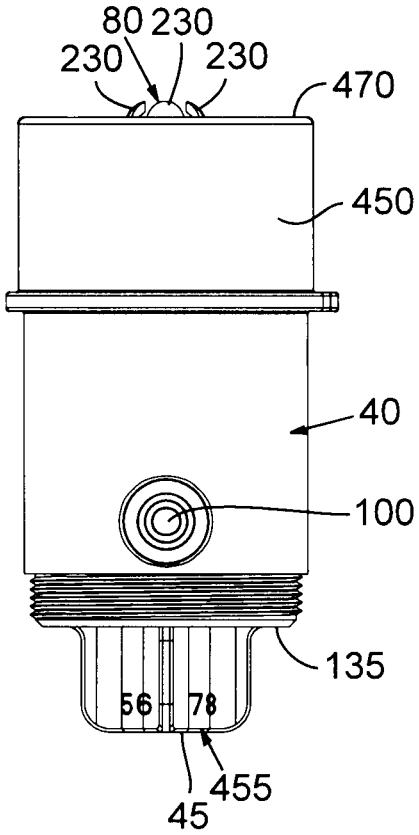
FIG. 5 is a top view of a pin front shell of the connector FIG. 4.
Figure 18:
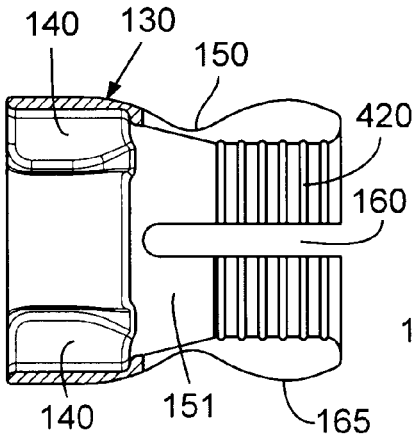
Figure 20:
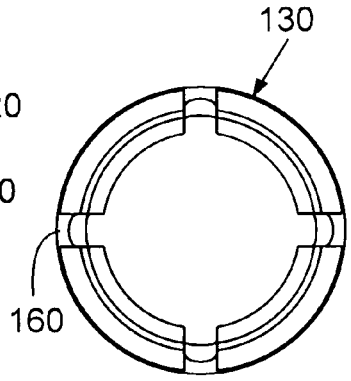
Figure 21:
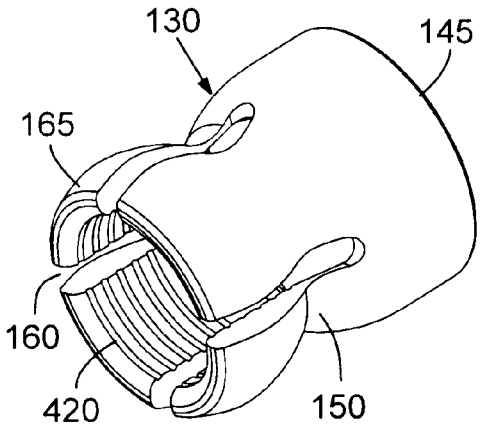
Figure 22:
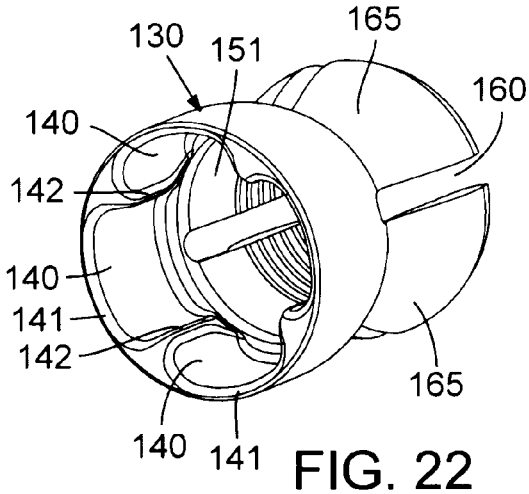
Figure 23:
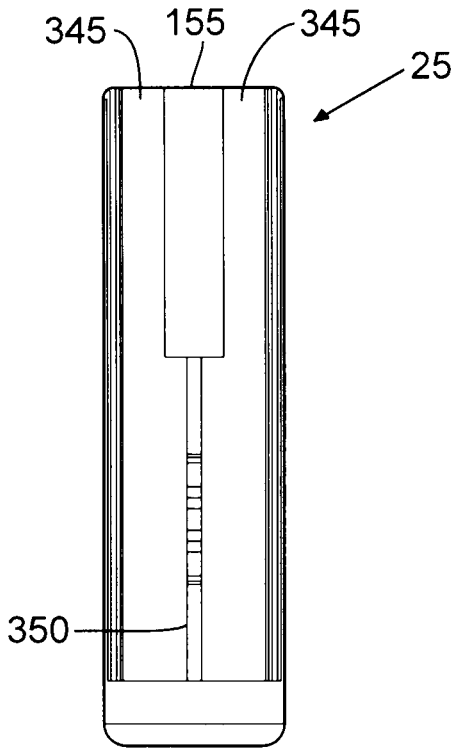
FIGS. 23, 24, 25, and 26 are respective top, left side section, right-rear isometric, and left-front isometric views of a sheath of the connector of FIG. 4, with a cover of the sheath (illustrated in FIGS. 27-30) omitted to show detail.
Figure 24:
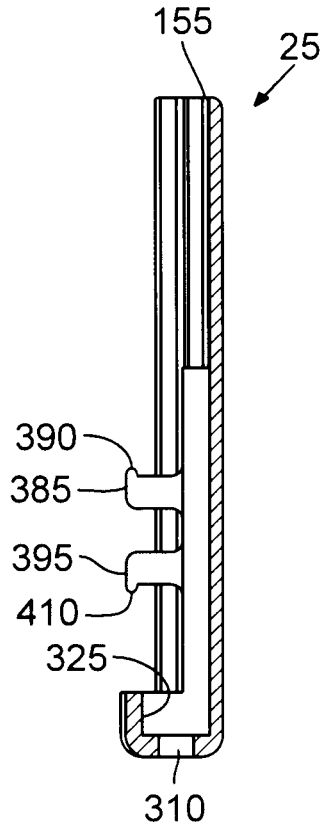

With reference to FIGS. 2 and 4, an optional electrically conductive annular shield ferrule (shield 130) is located over post 45, for example, by encircling post 45, and a portion of each insulating sheath 25. Shield 130 abuts a rear face 135 (best illustrated in FIGS. 5 and 8) of the pin front shell 40. Multiple indents or recesses 140 (best illustrated in FIGS. 18 and 22) are formed on an internal surface of electrically conductive shield 130 proximate a front end 145 (FIG. 21). Each recess 140 receives a rear end of one of the insulating sheaths 25. A radiused or chamfered surface 141 preferably surrounds or substantially surrounds each recess 140 to facilitate seating shield 130 over several sheaths 25 after sheaths 25 have been inserted into cavities 35. Preferably, the recesses 140 and insulating sheaths 25 cooperate to mechanically couple the electrically conductive shield 130 with the pin front shell 40 to prevent rotational movement between pin front shell 40 and shield 130. In one embodiment the cavities 35, sheaths 25 and shield 130 are sized for a slight interference of approximately 0.003 inch such that achieving electrical contact between shield 130 and pin front shell 40 requires slightly flexing or compressing sheaths 25, thereby resulting in a tight hold. A raised ridge 142 (best illustrated in FIG. 22) between each recess 140 assists with providing electrical shielding for wires and contacts contained in each sheath 25. In a preferred embodiment, ridges 142 engage or contact fins 46 (best illustrated in FIG. 8) of front shell 40 to cooperatively encircle a portion of each sheath 25. In some embodiments, an electrically conductive shield is omitted.

In another embodiment (not illustrated), each ridge, such as ridge 142, includes a central longitudinal groove. A fin, such as a fin 46, mates into each such longitudinal groove to facilitate electrically isolating sheaths, such as sheaths 25, and the contacts and wires contained in each sheath. Mating a fin into a longitudinal groove also mechanically couples the conductive shield, such as conductive shield 130, to the front shell, such as front shell 40, to resist rotational movement therebetween when a rear shell, such as rear shell 170, is attached to the front shell.

Figure 9:
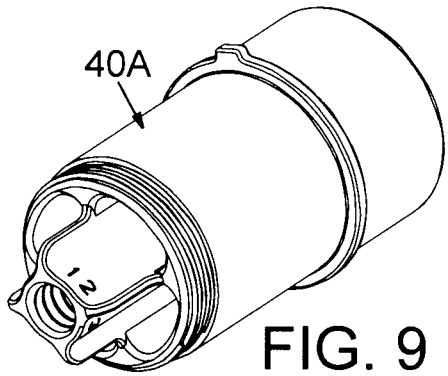
FIG. 9 is a right rear isometric view of another pin front shell.

In another embodiment (FIG. 3A), fins 46B may not step down, like fins 46 (best illustrated in FIG. 9). Post 45B may be shorter than posts, such as post 45, of other embodiments and insulating sheaths 25B (FIG. 23A) may be flush, or substantially flush, with face 135B. Insulating sheaths 25B are described in further detail below.

Figure 3A:
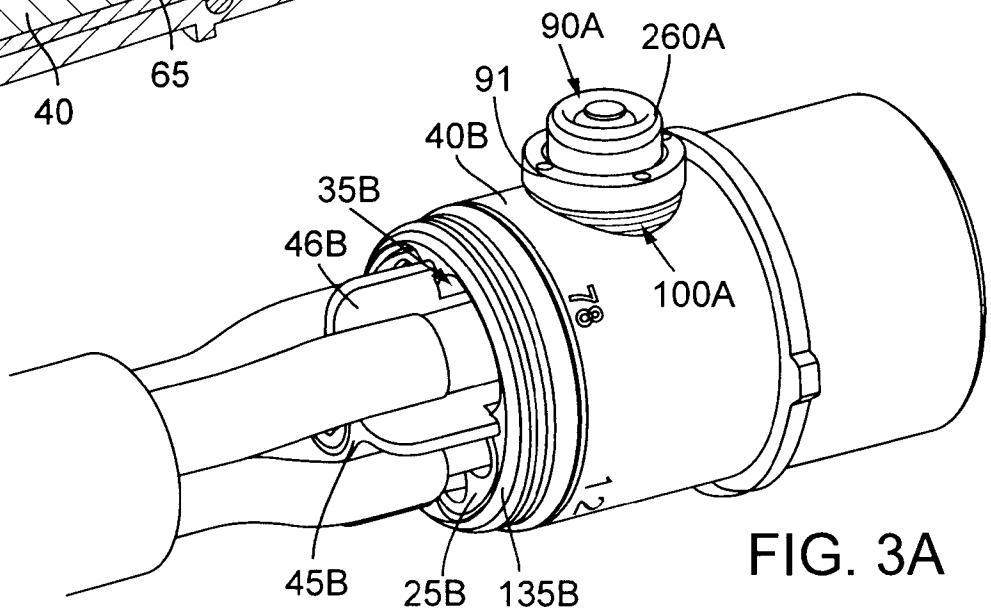
FIG. 3A is an isometric view of a pin connector according to a third embodiment with a rear shell and shielding ferrule of the connector omitted to show detail of a front shell of the connector and wires terminated by the connector.

In the embodiment illustrated in FIG. 3A, an optional electrically conductive shield, such as electrically conductive shield 130, may not include indents, such as recesses 140. Preferably, the optional electrically conductive shield includes a front end, such as front end 145 (FIG. 21), that engages a back surface of insulating sheaths 25B to mechanically engage such insulating sheaths 25B and retain them within the pin front shell 40B when a rear shell, such as rear shell 170 (FIG. 2) is attached to the pin front shell 40B. In some embodiments, a retaining clip (not illustrated) or other suitable device may be used to retain insulating sheaths 25B in the pin front shell 40B.

Figure 11:
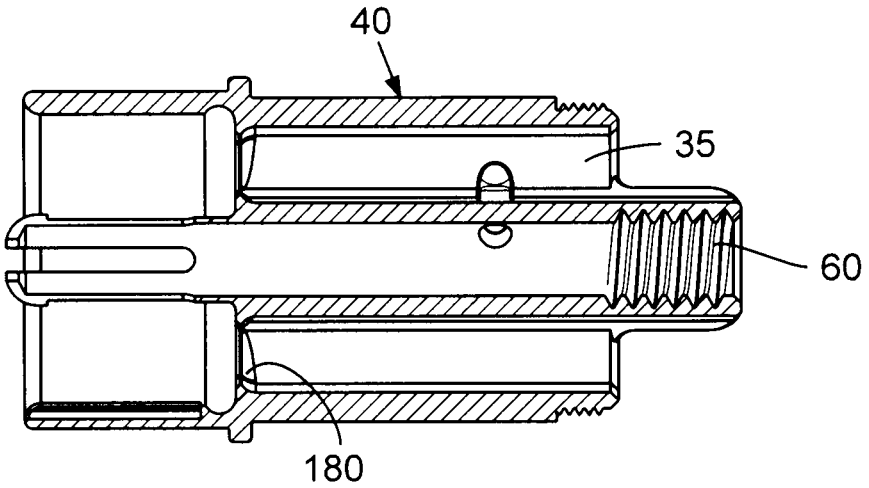
FIG. 11 is a left-side cross-section view of the pin front shell of FIG. 5, rotated 90° about a longitudinal axis compared to FIG. 10.
Figure 19:
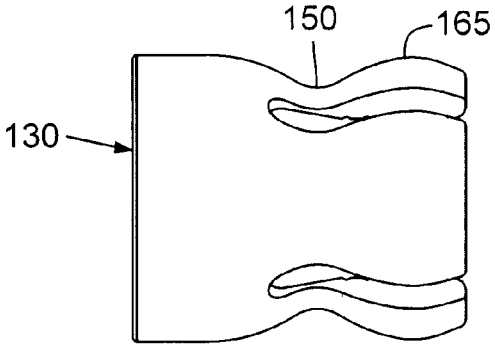
Figure 25:
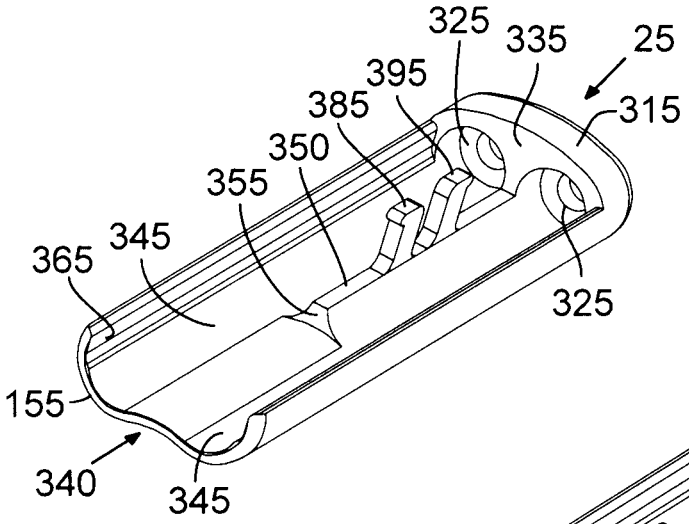
Figure 26:
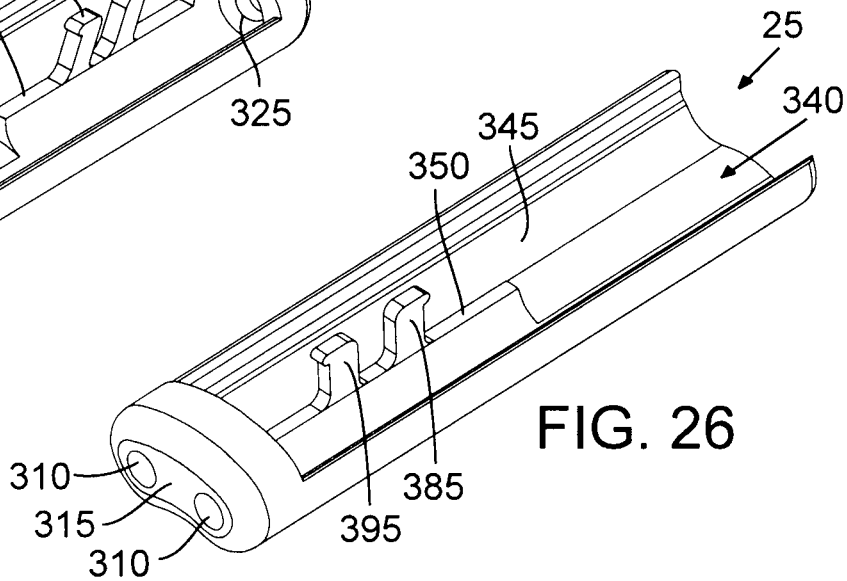

When the optional electrically conductive shield 130 abuts face 135 (FIG. 8) of the pin front shell 40, a waist portion 150 (FIG. 19) of shield 130, which has a lesser outer diameter than both end portions of shield 130, is proximate a rear end 155 (FIG. 25) of each sheath 25. Slots 160 (FIG. 22) formed in electrically conductive shield 130 create cantilever beams 165 collectively forming a flexible rear skirt portion of shield 130. In the illustrated embodiment, slots 160 extend through waist portion 150. When an electrically conductive rear shell 170 (FIGS. 2 and 4) is attached to the pin front shell 40, as described below with reference to FIGS. 2 and 4, cantilever beams 165 flex radially inwardly toward a central axis 175 (FIG. 10) of pin front shell 40 when rear shell 170 is coupled to pin front shell 40, thus constricting, or narrowing, an internal opening 151 (FIGS. 18 and 22) of waist portion 150 to urge and retain sheaths 25 toward a front end 41 (FIG. 7) of the pin front shell 40. This radially inward flexure of cantilever beams 165 may also cause beams 165 to clamp around wires and shielding material of the cable to ensure a grounding contact and to provide cable strain relief. Each sheath 25 contacts an internal lip 180 (FIG. 11) in each of the cavities 35 of pin front shell 40 and is maintained in such contact when waist portion 150 of electrically conductive shield 130 is constricted.

Rear shell 170 is preferably releasably attached to pin front shell 40. Rear shell 170 is made from electrically conductive materials or from insulating materials coated or covered with conductive materials, such as those used to make pin front shell 40 as described above. In the embodiment of pin connector 10 (FIG. 4) pin front shell 40 and rear shell 170 attach or connect via a set of mating threads. However, other suitable connectors, such as a bayonet connector or snap-fit connector, may be used. In other embodiments, a facial seal, similar to facial seal 115 (FIG. 4), may be included proximate the rear 50 (FIG. 4) of pin front shell 40 to inhibit moisture from entering a pin connector, such as pin connector 10, between the rear shell and the front shell. In some embodiments, a rear shell, such as rear shell 170, is omitted. When no electrically conductive shield or rear shell are included, electrically non-conductive sheaths are preferably held in the front shell by a cover, retaining clip, strain relief, or other suitable device. Thus, some embodiments may include only an electrically conductive front shell and electrically non-conductive sheaths retained in the front shell. Such electrically non-conductive sheaths may be configured to hold a single contact, or may hold two or more contacts.

Socket Contact Component Arrangement

Socket connector 15 is described with reference to FIGS. 2 and 40. In a preferred embodiment, several components forming socket connector 15 are identical to several of the components forming pin connector 10. Like the pin connector embodiments described above, the electrically conductive shield and rear shell are optional for some socket connector embodiments. The same reference number is used to identify such identical components, for example, an identical rear shell 170 is used to form both the pin connector 10 and the socket connector 15 in a preferred embodiment. One advantage of using identical components to form both the pin connector 10 and the socket connector 15 is to reduce the number of unique components needed to create an electrical connector, such as electrical connector 5. One of ordinary skill in the art will recognize that it is not necessary for such components to be identical, and that such components may include relatively minor differences or relatively major differences.

Socket connector 15 includes multiple pairs of socket contacts 190 that terminate the ends of multiple twisted wire pairs (not illustrated for clarity). Each pair of socket contacts 190 terminating a corresponding pair of wires of a twisted pair are physically separated from each of the other three pairs of socket contacts 190 by locating each pair of socket contacts 190 in an electrically insulating sheath 25A, or non-conductive socket housing. Each sheath 25A is closed by a cover 30. In other exemplary embodiments, there may be only one electrically non-conductive housing or sheath that includes multiple chambers where each chamber houses a pair of socket contacts 190.

In yet other exemplary embodiments, an electrically non-conductive housing or sheath, such as sheath 25A, may be configured to contain only a single contact.

Figure 50A:
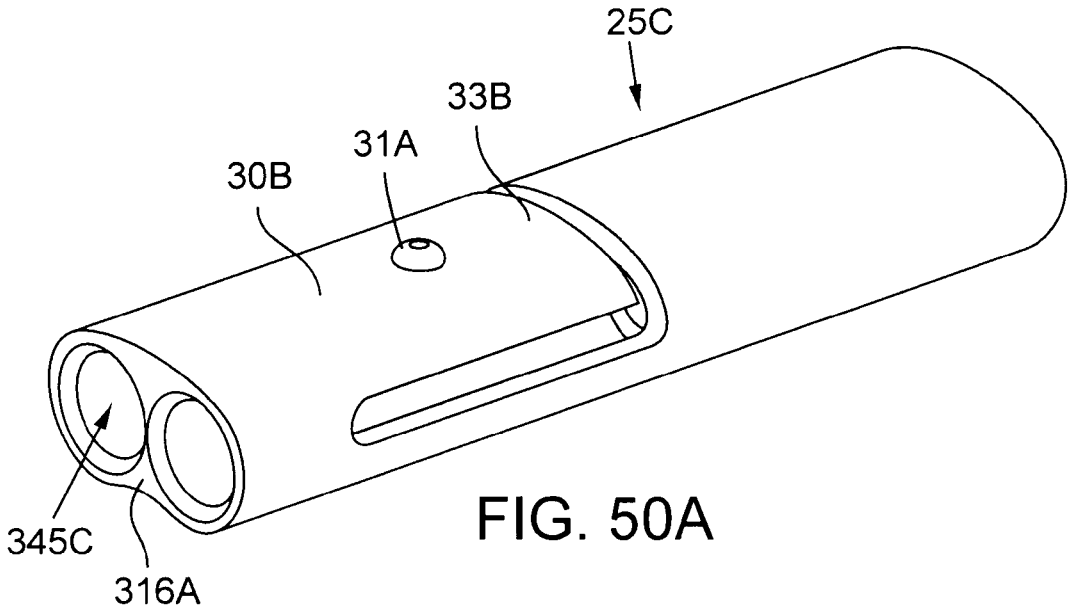
FIG. 50A is a right-side rear isometric view of sheath for socket contacts according to another embodiment.

Each sheath 25A, containing a pair of socket contacts 190 terminating wires of a twisted pair and located in a chamber closed by a cover 30, is inserted into a cavity 195 in a conductive socket front shell 200. In one embodiment, each cavity 195 surrounds a substantial portion of each insulating sheath 25A, and a post section 205 extending from a rear end 210 of the conductive socket front shell 200 provides physical support for at least a portion of each insulating sheath 25A. In other exemplary embodiments, a conductive socket front shell, such as socket front shell 200, may include cavities, such as cavities 195, that extend for substantially the same length as each insulating sheath 25A, and a post section, such as post section 205, may not be included. In other embodiments, insulating sheaths 25C (FIG. 50A) may be included and may have an end that is flush, or substantially flush, with a face, such as face 215, located at the rear of a socket front shell, such as socket front shell 200. In such embodiments, a post section, such as post section 25, may be relatively shorter and fins, such as fins 206, may have a relatively greater height. Additionally, an electrically conductive shield, such as electrically conductive shield 130 may not include indents, such as recesses 140, to thereby facilitate holding insulating sheaths 25C in the front shell, but may engage a rear surface of sheaths 25C, for example, as described above.

An optional electrically conductive annular shield 130 is located over post 205, for example, by encircling post 205, and a portion of each sheath 25A. Optional electrically conductive shield 130 abuts a face 215 of the conductive socket front shell 200. Multiple indents, or recessed portions, 140 (best illustrated in FIGS. 18 and 22) are formed on an internal surface of electrically conductive shield 130 proximate a front end 145 (FIG. 21). Each recess 140 receives one of the insulating sheaths 25A. A radiused or chamfered surface 141 preferably surrounds, or substantially surrounds, each recess 140 to facilitate seating a sheath 25 in an recess 140. Preferably, the recesses 140 and insulating sheaths 25A cooperate to mechanically engage the electrically conductive shield 130 with the conductive socket front shell 200 to prevent rotational movement between conductive socket front shell 200 and electrically conductive shield 130. A raised ridge 142 (best illustrated in FIG. 22) between each recess 140 assists with providing electrical shielding for wires and contacts contained in each sheath 25A. In a preferred embodiment, ridges 142 engage or contact fins 206 (best illustrated in FIGS. 2 and 40) to cooperatively encircle and electrically isolate a portion of each sheath 25A.

Figure 42:
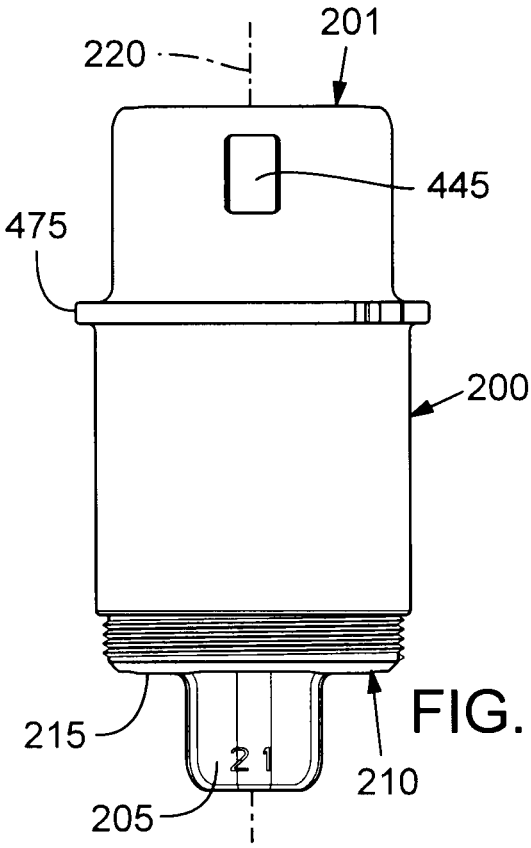
FIG. 42 is a top view of the conductive socket front shell of FIG. 41.
Figure 44:
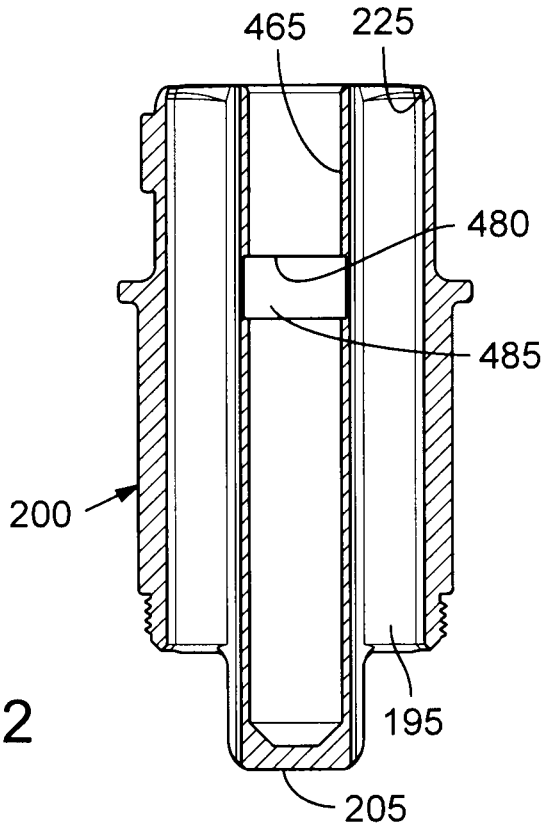
FIG. 44 is a left-side cross-sectional view of the conductive socket front shell of FIG. 41.
Figure 43:
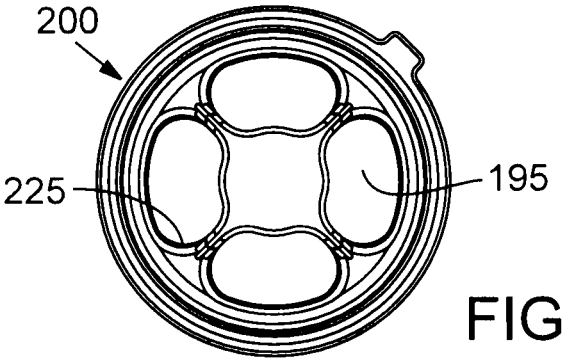
FIG. 43 is a rear view of the conductive socket front shell of FIG. 41.
Figure 48:
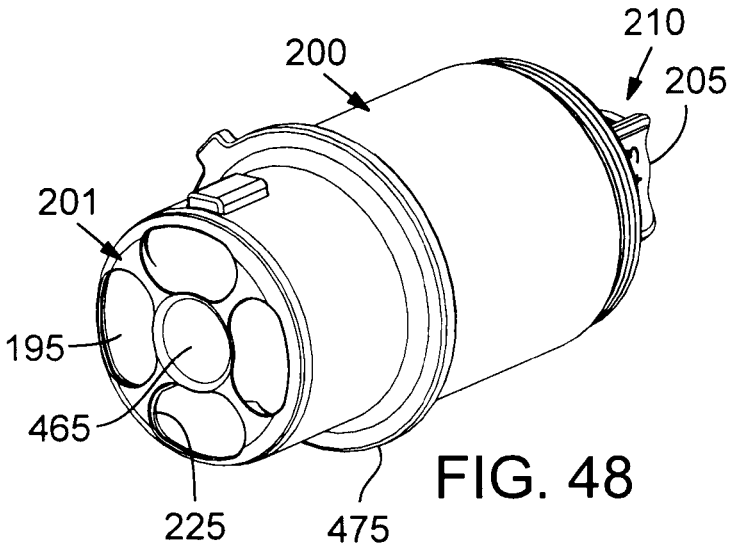
FIG. 48 is a right-side front isometric view of the conductive socket front shell of FIG. 41.
Figure 45:
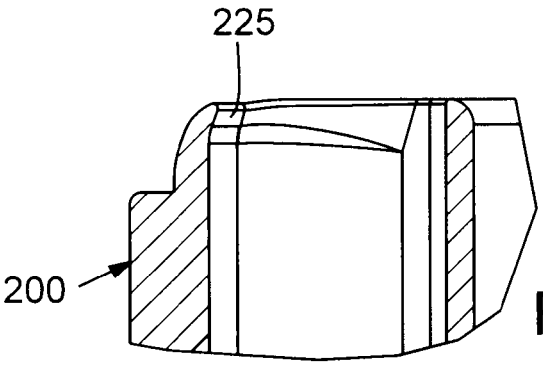
FIG. 45 is an enlarged left-side cross-sectional view of the conductive socket front shell of FIG. 41.
Figure 49:
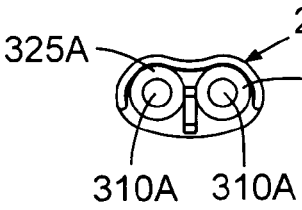
FIGS. 49, 50, 51, 52, and 53 are respective rear end, top plan, right side section, left-front isometric, and right-rear isometric views of a contact-retaining sheath of the connector of FIG. 40.
Figure 50:
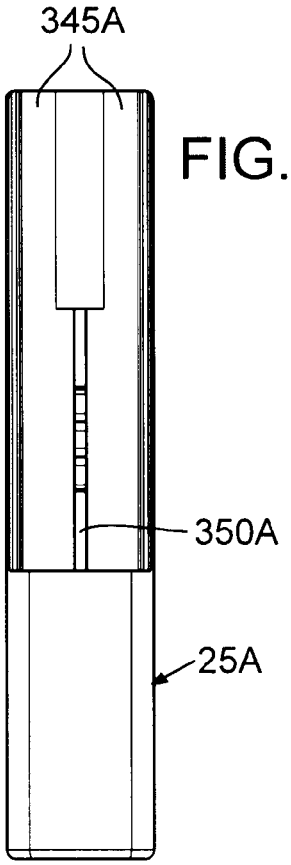
Figure 52:
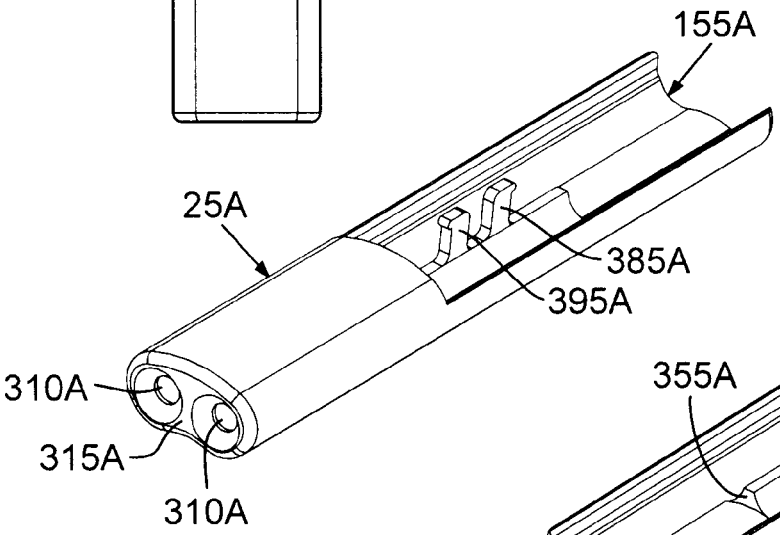
Figure 53:
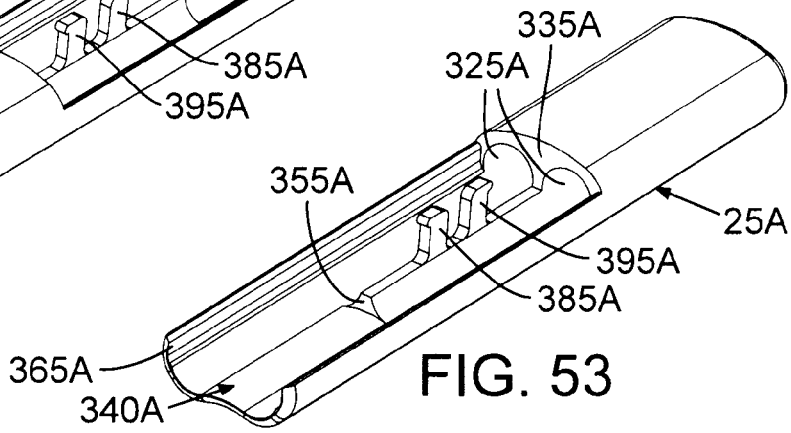

When the optional electrically conductive shield 130 abuts face 215 of the conductive socket front shell 200, a waist portion 150 of the electrically conductive shield 130, which has a lesser outer diameter than both end portions of shield 130, is proximate a rear end 155A (FIG. 52) of each insulating sheath 25A. When an optional conductive rear shell 170 is attached to the conductive socket front shell 200, as described below with reference to FIGS. 2 and 4, cantilever beams 165 of conductive shield 130 move toward a central axis 220 (FIG. 42) of socket connector 15, thus constricting, or narrowing, an internal opening 151 (FIGS. 18 and 22) of waist portion 150 to urge and retain insulating sheaths 25A toward a front face 201 (FIGS. 42 and 48) of the conductive socket front shell 200. Each sheath 25A contacts an internal lip 225 (FIG. 44) in each of the cavities 195 of conductive socket front shell 200 and is maintained in such contact when waist portion 150 of electrically conductive shield 130 is constricted.

Optional electrically conductive rear shell 170 engages electrically conductive socket front shell 200 similar to the engagement of conductive rear shell 170 to pin front shell 40 described above with reference to FIG. 4.

Figure 16:
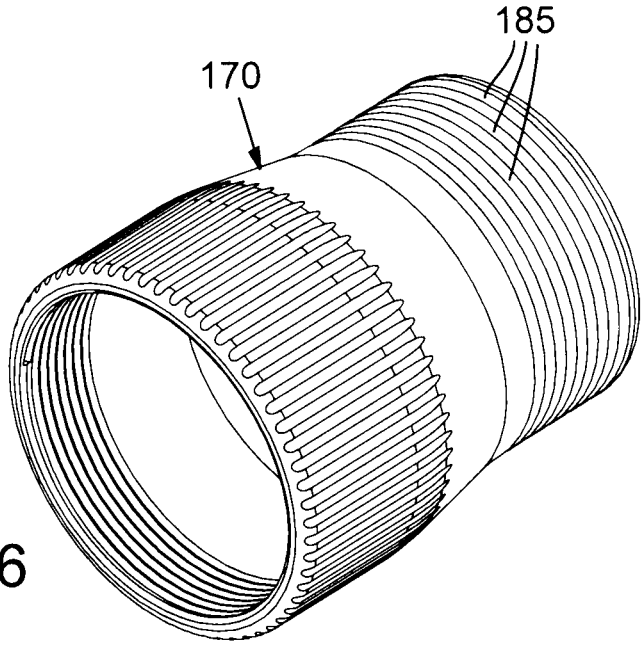
Figure 17:
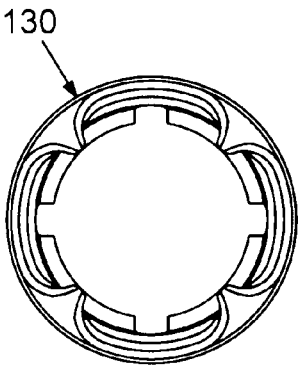
FIGS. 17, 18, 19, 20, 21, and 22 are respective a front end, left side section, side elevation, rear end, and rear and front isometric views of an electrically conductive shield ferrule of the connector of FIG. 4.
Figure 39:
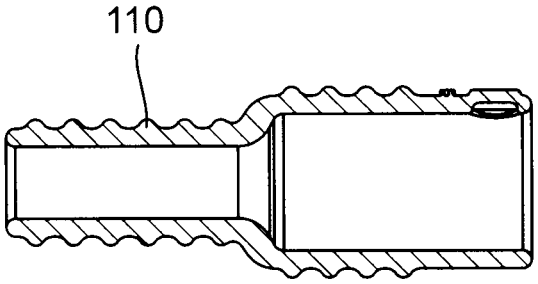

With reference to FIG. 2, in one embodiment boots 110 and 110A are attached to the pin connector 10 and the socket connector 15, respectively. Boots 110 and 110A are made from an elastic material, preferably fluorosilicone with a hardness of approximately 45 Shore A to approximately 50 Shore A, and are slid into place over rear shells 170 and over pin front shell 40 and socket front shell 200. For the pin connector 10, the boot 110 is slid over the pin front shell 40 far enough to cover release button 90. Boot 110 may optionally include internal annular rings protruding above surface 111 (FIG. 39) to facilitate sealing around cable and wires entering either the pin connector 10, the socket connector 15, or both. Boot 110, when slid into place on the pin connector 10 is preferably tight enough to substantially prevent moisture from entering through button aperture 100 or cable aperture 11. A series of annular grooves 185 formed in rear shell 170 (FIG. 16) assist with holding boots 110 and 110A in place and with forming a seal between boots 110 and 110A and rear shells 170, for example, by providing a place for portions of boots 110 and 110A to deform into thus creating O-ring like seals. In other embodiments where a release button, such as release button 90A (FIG. 3A), includes a sealing element, a boot, such as boot 110, may not cover the release button.

Assembling and Connecting an Electrical Connector

Pin connector 10 is preferably assembled in two stages, a factory stage and a field stage, to facilitate ease of assembly for a user in the field by eliminating the need to assemble relatively small, delicate components in the field. The factory stage involves assembling the optional locking and release mechanisms 55 and 85, respectively, into the pin front shell 40 in a controlled environment, such as a facility where the locking and release mechanism components are made, or a suitable assembly facility where the locking and release mechanism components are shipped for assembly. The field stage involves terminating wires with pin contacts 20, securing pin contacts 20 in sheaths 25, and securing sheaths 25 in pin front shell 40. Socket connector portion 15 is assembled in one field stage that involves terminating wires with socket contacts 190, securing socket contacts 190 in sheaths 25A, and securing sheaths 25A in socket front shell 200. The assembly of pin connector 10, of socket connector 15, or both may occur entirely in a factory environment or entirely in a field environment. Consequently, the following discussion of factory assembly stage and field assembly stage is merely exemplary, and not intended to limit the assembly method to a particular environment.

Assembling a Pin Contact Embodiment

With reference to FIG. 4, the factory assembly stage includes inserting connecting post 65 into locking bore 60, followed by inserting spring 70 into locking bore 60. Set screw 75 is threaded into a rear end of locking bore 60 to compress spring 70 which urges connecting post 65 into engagement with the front end 80 (FIG. 10) of the locking bore 60. The longitudinal position of set screw 75 in locking bore 60 may be adjusted to adjust the amount of force exerted by spring 70 on connecting post 65. In some embodiments, an internal circumferential step in a locking bore, such as locking bore 60, and a mating, external circumferential step on a connecting post, such as connecting post 65, may be included. The two circumferential steps preferably limit the amount of travel for the connecting post toward the front end of the locking bore, regardless of the force exerted by a spring, such as spring 70. A thread locking material, such as one available under the Loctite® brand produced by Henkel, of Düsseldorf, Germany, is preferably used to secure set screw 75 in place once spring 70 has been sufficiently compressed. In another embodiment, a plug (not illustrated) is inserted into locking bore 60 with a press or interference fit to hold spring 70 in place.

With reference to FIGS. 10 and 12, the front end 80 of the structure forming locking bore 60 includes multiple cantilever beams 230 extending from an internal face 235 of pin front shell 40. Four slots 240 separate cantilever beams 230. A snap-lock ridge 245 is formed in each cantilever beam 230 proximate the free end thereof external to the locking bore 60. Collectively, cantilever beams 230 form an electrically conductive insertion plug 231 projecting from front face 43 of pin front shell 40 in the axial direction from a location between the contact openings in front face. In some embodiments, insertion plug 231 includes a locking/latching feature, such as cantilever members or beams 230 with snap-lock ridges 245 or other suitable radially outward projecting portions proximate a free end of the cantilever members, or another locking mechanism such as a ball lock. In other embodiments, an insertion plug, such as insertion plug 231, may not include a locking feature, and may not include a bore, such as locking bore 60.

Figure 10A:
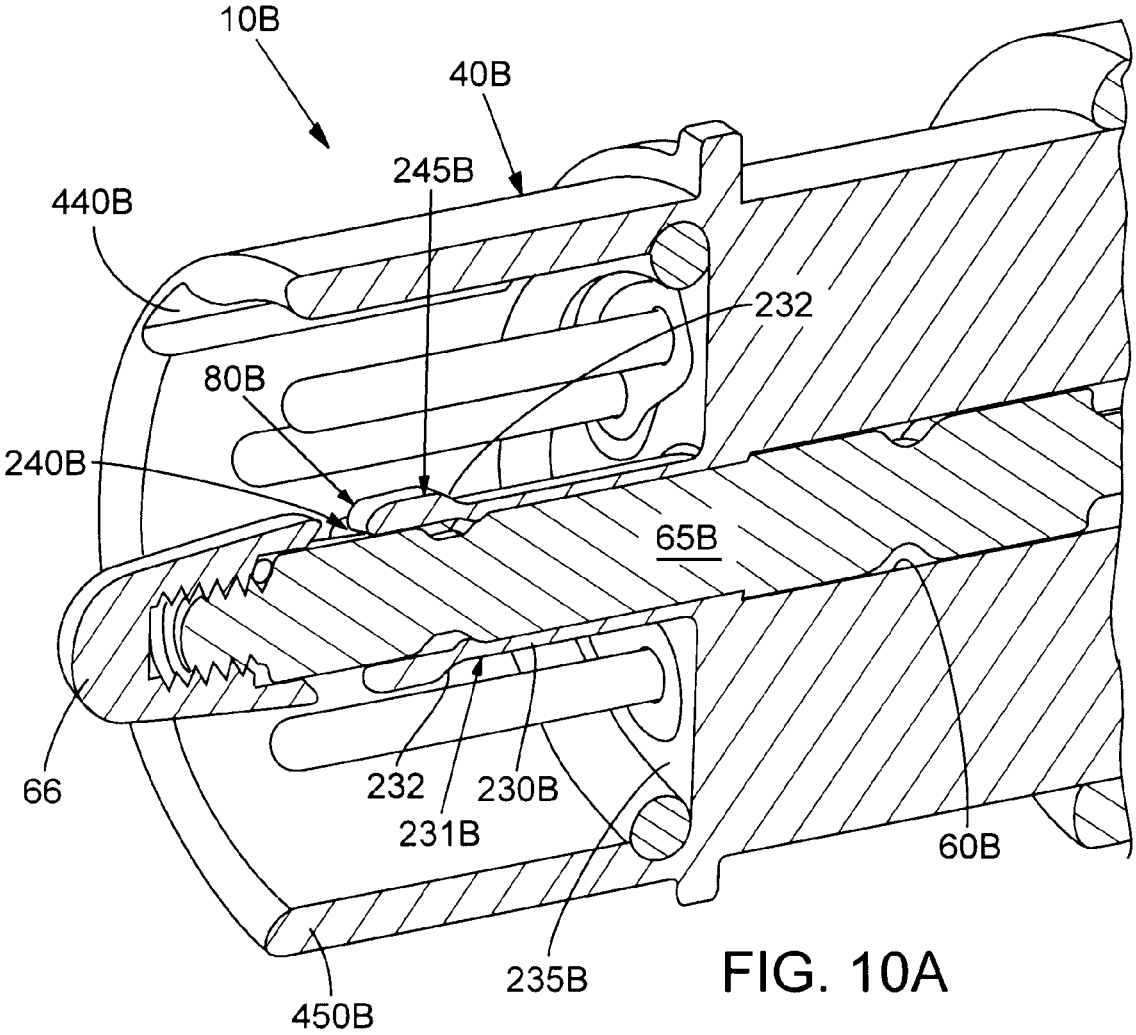
FIG. 10A is a left-side cross-section detail view of a pin connector according to another embodiment showing detail of a latch mechanism and connecting post.

In yet other embodiments, the front end 80B (FIG. 10A) of the structure forming locking bore 60B includes multiple cantilever beams 230B extending from an internal face 235B of pin front shell 40B. Four slots 240B separate cantilever beams 230B. Instead of a snap-lock ridge, such as snap-lock ridge 245, each cantilever beam 230B bears a modified snap-lock feature 245B, such as radiused surface 232 proximate the free end thereof external to the locking bore 60B. Collectively, cantilever beams 230B form an insertion plug 231B. As illustrated in FIG. 10A, connecting post 65B protrudes past front end 80B and includes a protective cap 66 that inhibits bending of cantilever beams 230B when a pin connector, such as pin connector 10B, and a socket connector, such as socket connector 15, are brought together. Protective cap 66 is affixed to connecting post 65B, preferably via threads, a snap-fit, a press fit or other suitable connection.

Internal to the locking bore 60 and proximate the front end 80 a radius section of each cantilever beam 230 provides an engagement surface 250 (FIG. 12). When connecting post 65 is inserted into locking bore 60 and urged toward the front end 80 by spring 75, a front end surface 255 of connecting post 65 (FIG. 31), contacts engagement surface 250, which urges the free ends of cantilever beams 230 away from central longitudinal axis 175 of pin front shell 40.

Figure 33:
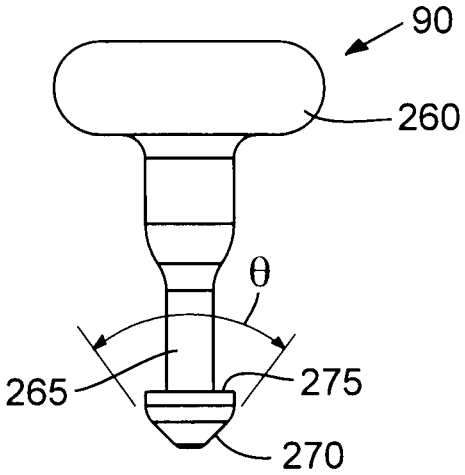
FIGS. 33 and 34 are side and isometric views of a latch release button of the connector of FIG. 4.
Figure 34:
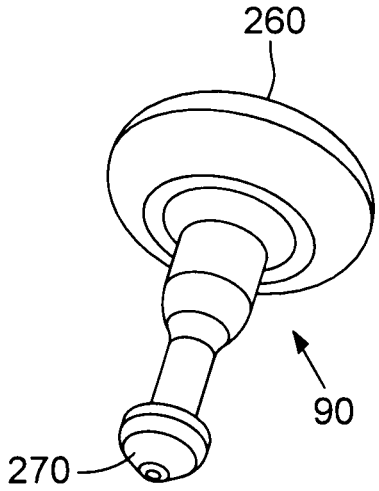

Referring again to FIG. 2, once connecting post 65 is secured in locking bore 60, release button 90 is inserted into button aperture 100 (FIG. 4). Release button 90 includes an external button portion 260 (FIGS. 33 and 34), a shaft 265, and an engagement surface 270 located on the shaft 265 distal from external button portion 260. In one embodiment, engagement surface 270 includes a truncated conical shape having an internal angle θ of approximately 90° between outer surfaces of the conical shape.

Figure 7:
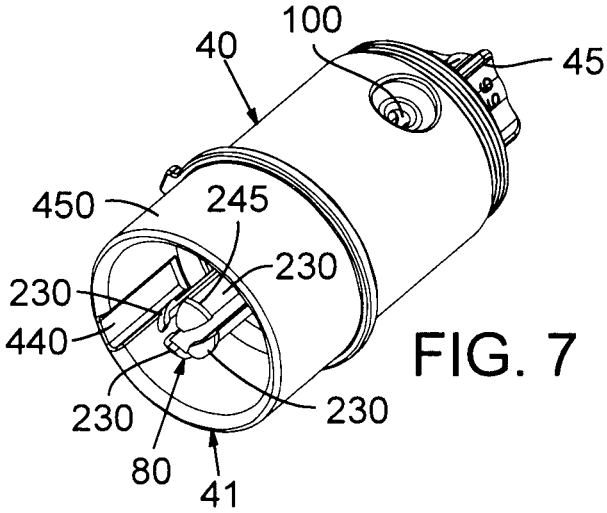
FIG. 7 is a left front isometric view of the pin front shell of FIG. 5.
Figure 31:
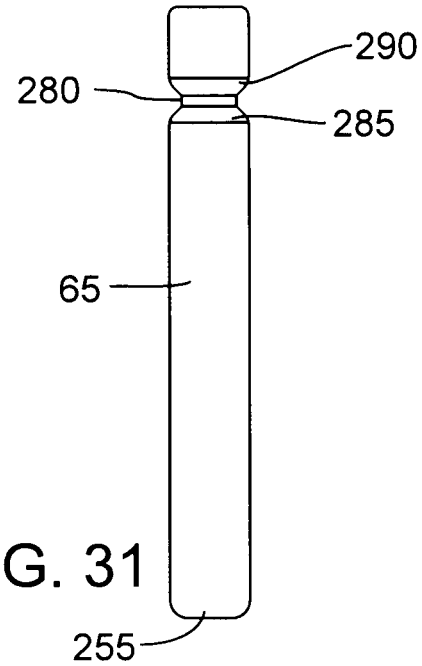
FIGS. 31 and 32 are side and isometric views of a connecting post of the connector of FIG. 4.
Figure 32:
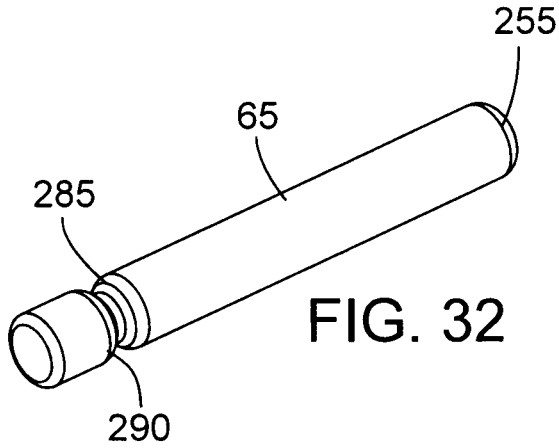
Figure 35:
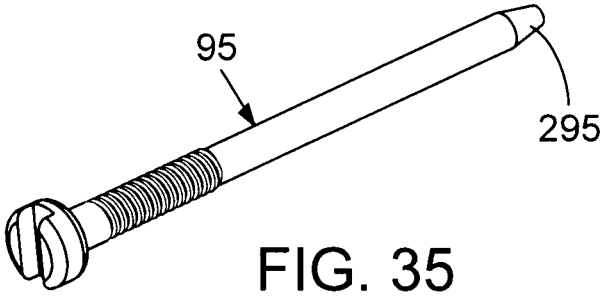
FIG. 35 is an isometric view of a retaining pin of the connector of FIG. 4.
Figure 36:
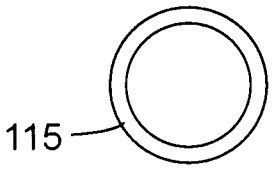
FIGS. 36 and 37 are front and side views of a facial seal of the connector of FIG. 4.
Figure 37:
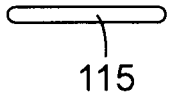
Figure 38:
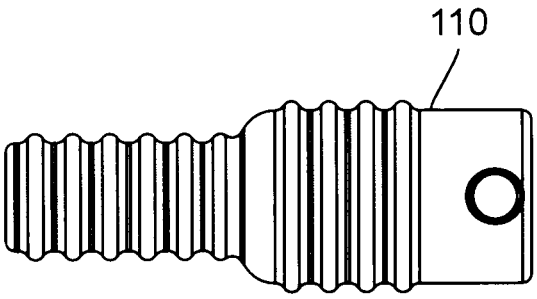
FIG. 38 are a top and side section views of a boot of the connector of FIG. 4.

With reference to FIGS. 2, 31, and 32, connecting post 65 includes a waist section 280 bounded by a rear facing surface 285 and a front facing surface 290. With spring 70 urging connecting post 65 toward front end 80 (FIG. 10) of locking bore 60, engagement surface 270 (FIG. 33) of release button 90 engages the front facing surface 290 bounding waist 280 of connecting post 65 when release button 90 is inserted into button aperture 100 (FIG. 7). Pin 95 is then secured in pin aperture 105 (FIG. 10), for example, via a press fit or mating threads with or without applying a thread locking material. Pin 95 includes an engagement surface 295 (FIG. 35) that engages a retaining lip 275 (FIG. 33) of release button 90. In other embodiments, engagement surface 295 of pin 95 may be an external sidewall of pin 95 and does not need to be tapered or shaped. Contacting engagement surface 295 with retaining lip 275 prevents release button 90 from being withdrawn from button aperture 100.

In one embodiment, the factory assembly stage provides a pin front shell 40 that is complete with a locking mechanism 55 and a release mechanism 85 and no loose parts, parts capable of becoming loose, or both. As described below with reference to FIGS. 2, 12, 31, and 33, the optional locking mechanism 55 holds a pin connector 10 in a locked engagement with a socket connector 15. As also described below with reference to FIGS. 2, 12, 31, and 33, operation of the optional release mechanism 85 disengages the locking mechanism so the pin connector 10 can be separated from the socket connector 15.

The field assembly stage includes preparing the end of a cable by stripping the outer jacket, such as jacket J (FIG. 1) and overall shielding, such as shielding S from a length of the end of the cable. Preferably, a relatively short amount of jacket J is removed to substantially maintain the impedance characteristics of the cable. Cable preparation also includes untwisting each twisted pair and stripping the insulating material from each wire. Preferably, such untwisting and stripping for each twisted pair involves untwisting and stripping a length of each wire that is approximately 0.40 inch to approximately 0.50 inch. In contrast, many currently available electrical connectors, such as those disclosed in the '584 patent discussed above, require 1.0 inch to 1.2 inches, or more, of untwisting and/or insulation stripping for each twisted pair. The present inventor has recognized that requiring a shorter distance of a twisted pair to be untwisted for insertion into an electrical connector, such as electrical connector 5, has one or more advantages. For example, one such advantage concerning untwisting a relatively short distance of each twisted pair is a reduced likelihood of creating NEXT between each twisted pair of wires, a reduced likelihood of impedance mismatches at the near end of a cable, the far end of a cable, or both, a reduced likelihood of creating FEXT between each twisted pair of wires, or a reduced likelihood of creating crosstalk between cables (also known as alien crosstalk), singularly or in any combination. The present inventor has also recognized that reducing impedance mismatches results in reducing reflected signals at the far end, which reduces signal losses at the far end and also reduces the likelihood of creating near end crosstalk resulting from interference from reflected signals.

Figure 54:
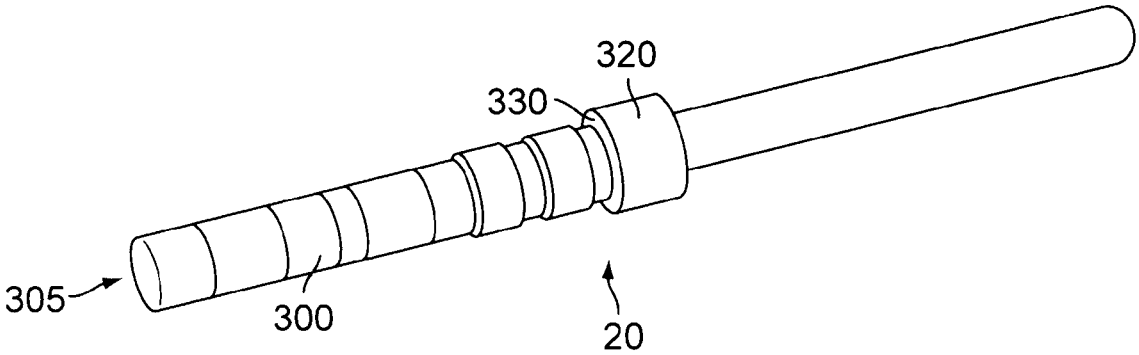
FIG.54 Prior Art
FIG. 54 is an isometric view of an exemplary pin contact.

With reference to FIG. 54, once an end of a cable has been prepared by untwisting and stripping approximately 0.4 inch to approximately 0.5 inch for each wire in each twisted pair, a pin contact 20 is used to terminate each such wire. For example, an exemplary pin contact 20 meeting the specifications of MIL-C-39029 includes a crimping barrel 300. A stripped end of a wire is inserted into the crimping barrel 300 and crimped in place as is well known. In other embodiments, other suitable pin contacts may be used and other suitable manners of attaching a wire to a pin contact may be used, such as soldering, for example. In a preferred preparation of each wire of a twisted pair, the insulating layer surrounding each such wire extends to approximately a rear end 305 of a pin contact 20. In other words, after a wire has been attached to a pin contact 20, the insulating layer preferably extends to within approximately 0.05 inch of the rear end 305 of a pin contact 20 to just contacting the rear end 305, that is, touching barrel 300.

With reference to FIGS. 4, 23-26, and 40, after each wire of a twisted pair has been terminated with a pin contact 20 (FIGS. 4 and 56), the pin contacts 20 are inserted into a sheath 25 without the use of tools. First, a portion of each pin contact 20 is inserted through a contact aperture 310 in a front wall 315 of a sheath 25. A collar 320 (FIG. 54) of each pin contact 20 rests in a collar pocket 325 so that a rear surface 330 (FIG. 54) of the collar 320 is approximately flush with a rear surface 335 of front wall 315 (as illustrated in FIG. 56). In one embodiment, collar pockets 325 are dimensioned to snap fit, press fit, or lightly hold, collars 320 in place. As best seen in FIG. 56, a twisted pair jacket "TPJ" covers the twisted portion of PAIR 1 and the twisted portion is proximate rear face 355 (FIG. 25) of dividing wall 350. Thus PAIR 1 is untwisted as little as possible. Additionally, the insulating layer "l" covering each of WIRE 1 and WIRE 2 preferably extends to a position proximate the rear end 305 of each pin contact 20, for example, as discussed above.

The barrel 300 of each pin contact 20 lies in a wire cavity 340 of a sheath 25. In the embodiment illustrated in FIGS. 2, 4, and 40, wire cavities 340 include first and second contact troughs 345 (FIG. 25) separated by a dividing wall 350 extending from a bottom of sheath 25. Dividing wall 350 extends rearward from rear surface 335 of front wall 315 a sufficient distance to provide physical and electrical isolation between barrels 300 of pin contacts 20. In one embodiment, the length of dividing wall 350 is approximately 0.08 inch to approximately 0.10 inch longer than the barrel 300 of pin contacts 20. Thus, dividing wall 350 also preferably provides physical and electrical isolation between any stripped portions of wires extending past rear end 305 of pin contacts 20.

When a twisted pair of wires terminated with pin contacts 20 is inserted into a sheath 25, an untwisted portion of the wires may be re-twisted together prior to such insertion. Such re-twisting preferably locates the end of the twisted portion of the wires as close as possible to rear face 355 of dividing wall 350 when pin contacts 20 are inserted through contact apertures 310, thus reducing, or minimizing, the length of the untwisted portion of the wire pair.

With reference to FIGS. 4, 23-30, and 40, rails 360 on cover 30 are inserted into grooves 365 in sheath 25 and cover 30 slides into place, closing a chamber, such as wire cavity 340. A head wall 370 of cover 30 is shaped and dimensioned to fit over barrels 300 of pin contacts 20 and to abut rear surface 330 of the collar 320 of pin contact 20 (FIG. 54). In other words, head wall 370 pinches, traps, or retains collars 320 in collar pockets 325 when cover 30 is locked in place on sheath 25.

With reference to FIGS. 27-30, third and fourth contact troughs 375 of the cover 30 are separated by a dividing wall 380 extending from an underside of cover 30. In one embodiment, the third and fourth contact troughs 375 are sized and dimensioned to contact barrels 300 thus further retaining pin contacts 20 in place when cover 30 is locked in place on sheath 25. Dividing wall 380 assists with providing physical isolation between the two pin contacts 20.

When cover 30 slides through grooves 365 of sheath 25, head wall 370 of cover 30 encounters first locking member 385 of sheath 25. A rounded surface 390 of first locking member 385 causes first locking member 385 to deflect toward second locking member 395 and slide over dividing wall 380 of cover 30 when head wall 370 of cover 30 contacts first locking member 385 of sheath 25. First locking member 385 then encounters aperture 400 of cover 30 which permits first locking member 385 to flex back to its original upright position. As cover 30 is further slid into place on sheath 25, a rounded surface 410 of second locking member 395 of sheath 25 encounters head wall 370 of cover 30, causing second locking member 395 to deflect away from first locking member 385 and slide over dividing wall 380 of cover 30. Second locking member 395 then encounters aperture 400 of cover 30 which permits second locking member 395 to flex back to its original upright position. When cover 30 is in its fully closed position, rounded surfaces 390 and 410 of first and second locking members 385 and 395 of sheath 25, respectively, engage edges of aperture 400 of cover 30 to lock cover 30 in place. Applying force to cover 30 in a direction away from front wall 315 of sheath 25 causes first and second locking members 385 and 395 to flex in directions opposite to those described above, and permits cover 30 to be removed from sheath 25.

Figure 23A:
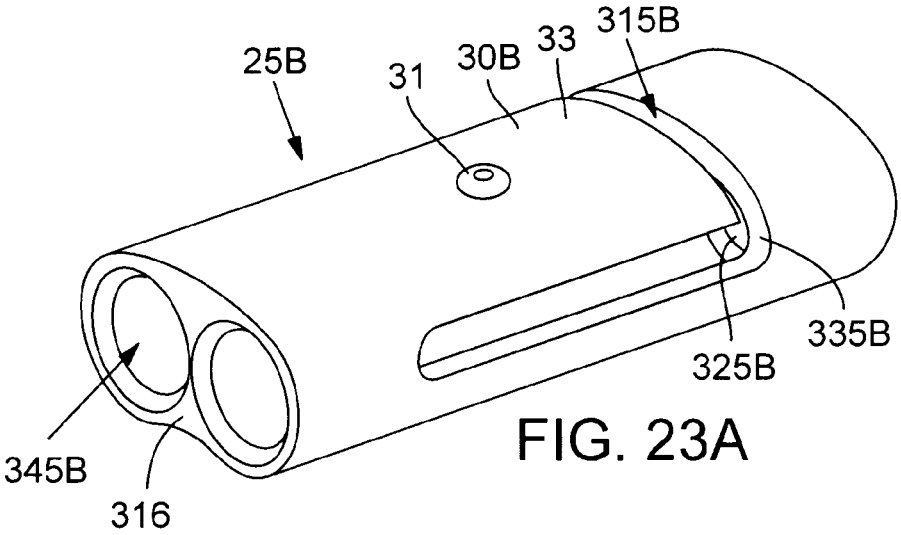
FIG. 23A is a right-rear isometric view of a pin contact sheath according to another embodiment.
Figure 23B:
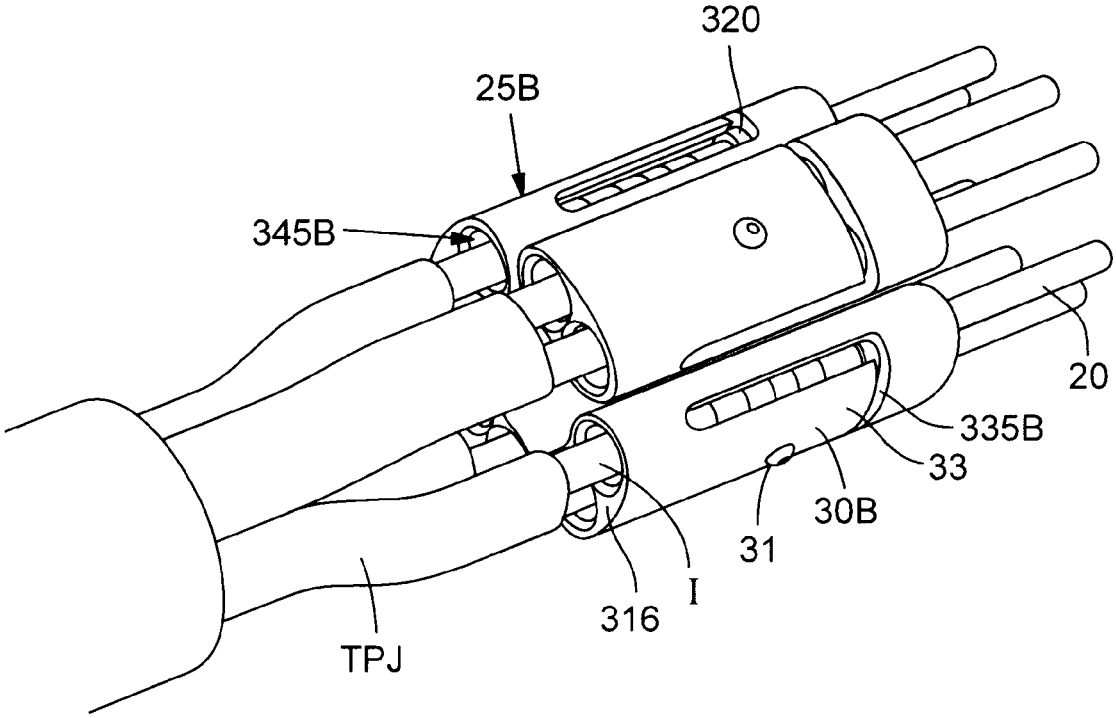
FIG. 23B is a pictorial view of an assembly of a cable and pin contacts with four of the sheaths of FIG. 23A.
Figure 27:
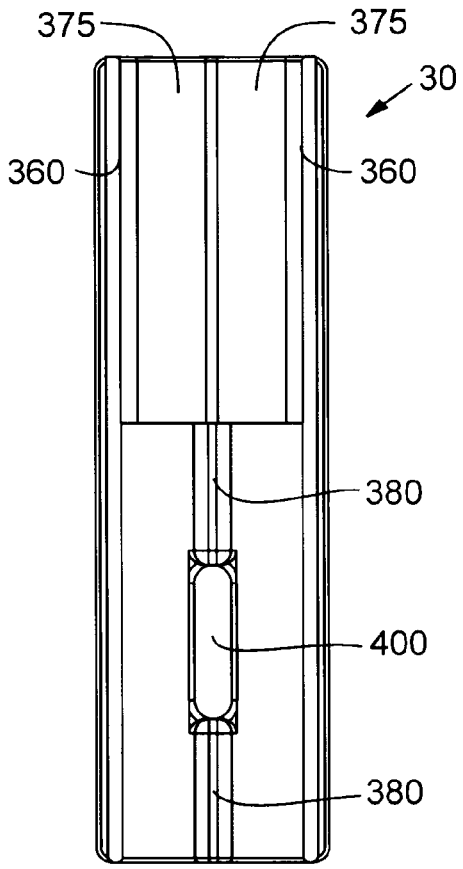
FIGS. 27, 28, 29, and 30 are respective bottom, right side section, bottom-right-front isometric, and top-left-front isometric views of a cover for the sheath of FIGS. 23-30.
Figure 28:
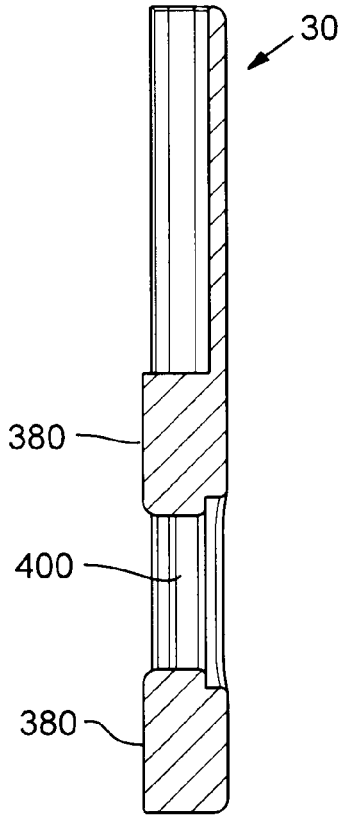
Figure 29:
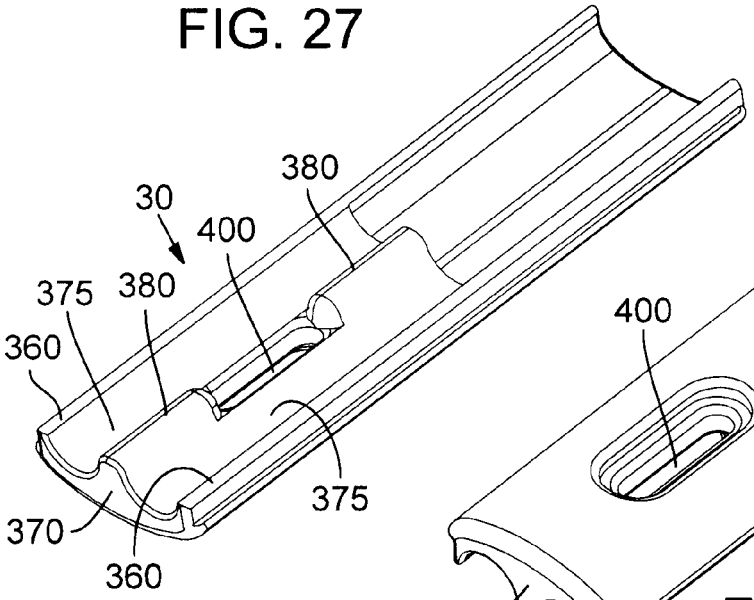
Figure 30:
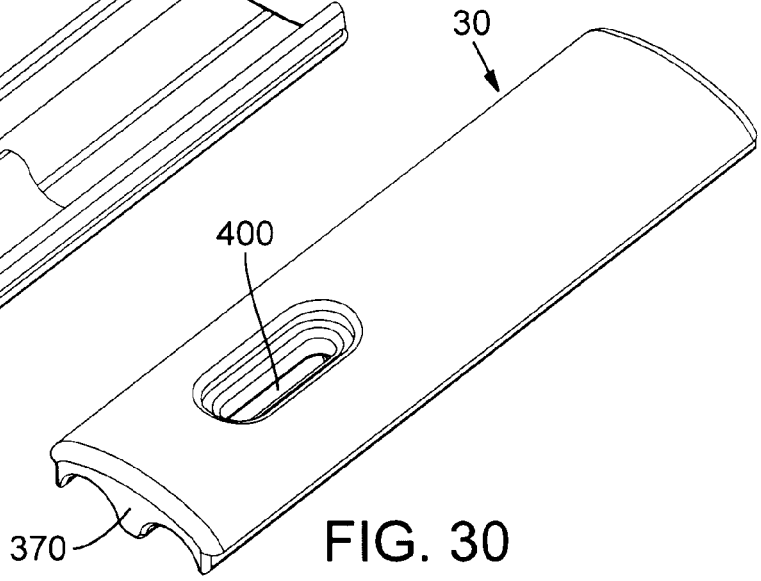

With reference to FIGS. 23A and 23B, in another embodiment, after each wire of a twisted pair has been terminated with a pin contact 20 (FIGS. 4 and 56), the pin contacts 20 are inserted into an insulating sheath 25B without the use of tools. Each sheath 25B may be located outside front shell 40 when the pin contacts 20 are inserted, or each sheath 25B may be located in front shell 40 when the pin contacts 20 are inserted. Preferably, when a sheath 25B is located in front shell 40 contact between button 31 and an inner wall of cavity 35 causes the forward end 33 of cantilever beam top 30B to produce an audible click when each pin contact 20 is properly seated. First, a portion of each pin contact 20 is inserted through a contact aperture 345B in a rear wall 316 of a sheath 25B. A collar 320 (FIG. 54) of each pin contact 20 rests in a collar pocket 325B so that a rear surface 330 (FIG. 54) of the collar 320 is approximately flush with a rear surface 335B of front wall 315B. In some embodiments, collar pockets 325B may be dimensioned to snap fit, press fit, or lightly hold, collars 320 in place. As best seen in FIG. 23B, a twisted pair jacket "TPJ" covers the twisted portion of PAIR 1 and the twisted portion is proximate rear wall 316. Thus PAIR 1 is untwisted as little as possible. Additionally, the insulating layer "l" covering each of WIRE 1 and WIRE 2 preferably extends to a position proximate the rear end 305 of each pin contact 20, for example, as discussed above.

The barrel 300 of each pin contact 20 lies in a wire cavity similar to wire cavity 340 discussed above to provide physical and electrical isolation between barrels 300 of pin contacts 20.

When a twisted pair of wires terminated with pin contacts 20 is inserted into a sheath 25B, an untwisted portion of the wires may be re-twisted together prior to such insertion. Such re-twisting preferably locates the end of the twisted portion of the wires as close as possible to rear wall 316 when pin contacts 20 are inserted through contact apertures 345B, thus reducing, or minimizing, the length of the untwisted portion of the wire pair.

Instead of including a cover, such as cover 30, sheaths 25B include a cantilever beam top 30B. Cantilever beam top 30B includes a front-facing surface positioned and configured to abut rear surface 330 of the collar 320 of pin contacts 20 (FIG. 54). In other words, cantilever beam top 30B pinches, traps, or retains collars 320 in collar pockets 325B when cover sheath 25B is inserted into a pin front shell, such as pin front shell 40B (FIG. 3A), and button 31 engages an inside surface of a cavity 35B (FIG. 3A) to press a forward end 33 of the cantilever beam top 30B toward pin contacts 20.

Figure 13:
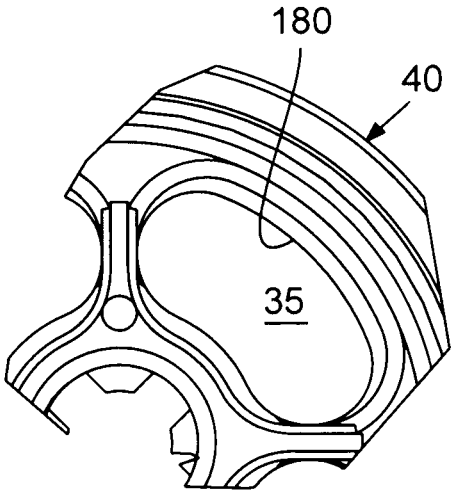
FIG. 13 is an enlarged rear view of the pin front shell of FIG. 5.

After each wire of each twisted pair has been terminated with a pin contact 20, and each pair of pin contacts 20 have been retained in a sheath 25 (or 25B) as described above, each sheath 25 (closed with a cover 30) is inserted into a cavity 35 in pin front shell 40. No tools are needed to insert each sheath 25 into a cavity 35. Each sheath 25 slides through a cavity 35 until contacting an internal lip 180 (FIG. 13) in each of the cavities 35.

With reference to FIG. 4, an optional electrically conductive shield 130 is slid over post 45 and a portion of each sheath 25 until contacting a face 135 (FIG. 8) of the pin front shell 40. Four sheaths 25, each loaded with terminated pin contacts 20, are inserted in recessed portions 140 (FIG. 22) of electrically conductive shield 130.

Figure 14:
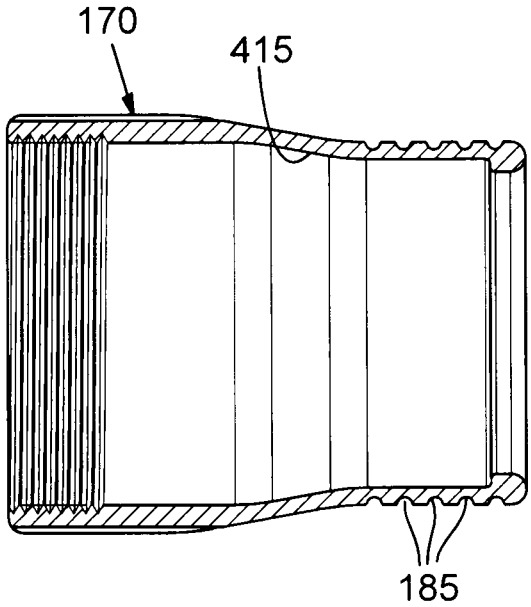
FIGS. 14, 15 and 16 are respective right-side cross-section, rear end and isometric views of a rear shell of the connector of FIG. 4.
Figure 15:
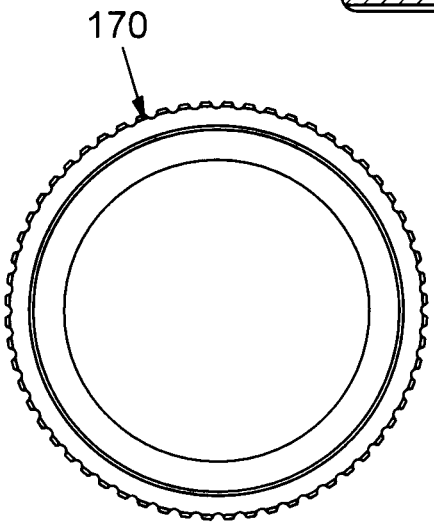

Next, the rear shell 170 is slid over electrically conductive shield 130 and attached to pin front shell 40, for example via a set of mating threads. As the optional rear shell 170 is threaded onto pin front shell 40, rear shell 170 is drawn closer to pin front shell 40, causing an internal sloped surface 415 (FIG. 14) of rear shell 170 to compress cantilever beams 165 (FIG. 21) of electrically conductive shield 130 toward central axis 175 (FIG. 10), thereby constricting an internal opening 151 (FIG. 18) of waist portion 150 of conductive shield 130. The constricted waist portion 150 contacts and retains sheaths 25 in place against internal lips 180 (FIG. 13) of pin front shell 40. Internal grooves 420 (FIG. 21) on each of the cantilever beams 165 of shield 130 facilitate gripping a cable and acting as a strain relief as cantilever beams 165 are moved toward central axis 175.

Boot 110 is slid into place over rear shell 170 and pin front shell 40 to cover release button 90 and provide a water and dust resistant environmental seal for pin connector 10.

Assembling a Socket Contact Embodiment

Figure 51:
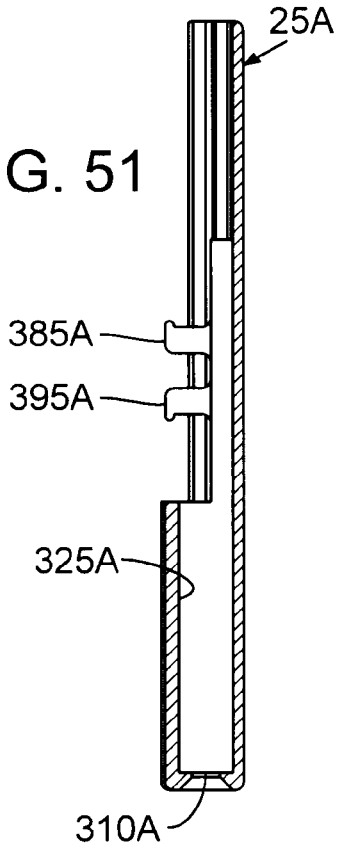
Figure 50B:
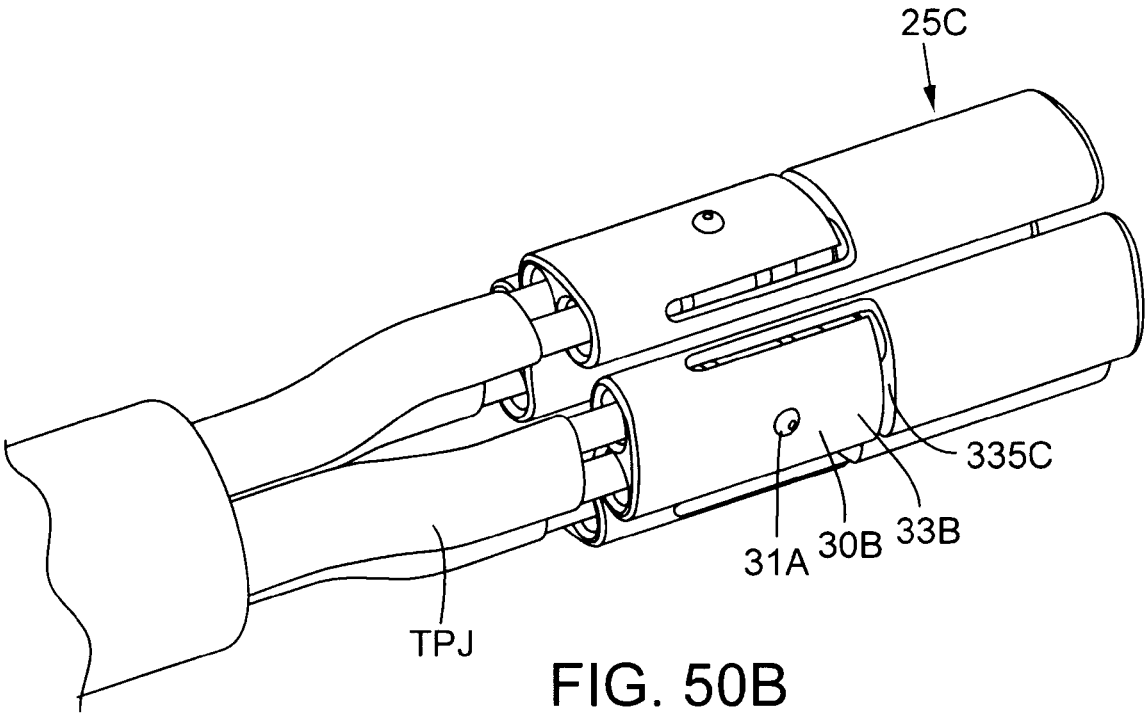
FIG. 50B is a pictorial view of an assembly of a cable and socket contacts with four of the sheaths of FIG. 50A.
Figure 55:
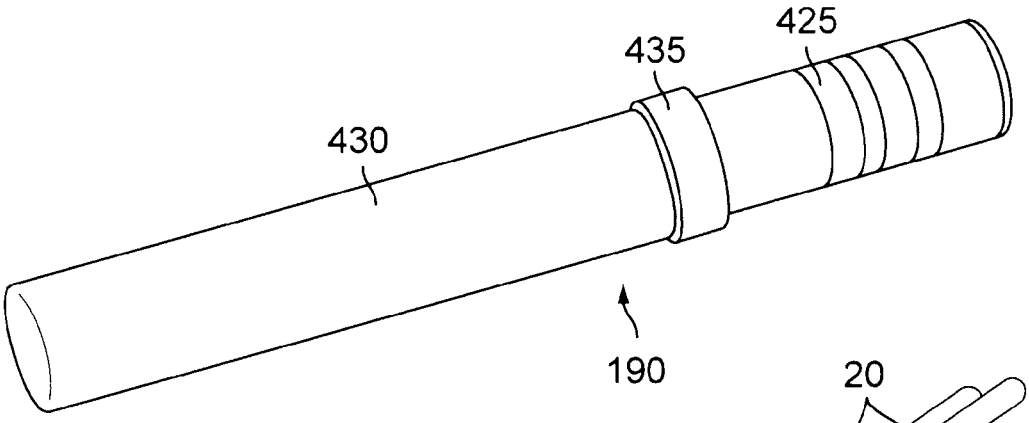
FIG. 55 Prior Art
FIG. 55 is an isometric view of an exemplary socket contact.

The field assembly stage for the socket connector 15 is similar to the field assembly stage for the pin connector 10. Each wire of each twisted pair is untwisted and stripped as described above. Each wire is crimped into a barrel portion 425 (FIG. 55) of a socket contact 190, or otherwise suitably attached to a socket contact. Socket contacts 190 are inserted into sheath 25A in a manner substantially similar to how pin contacts 20 are inserted into sheath 25, or into a sheath 25C (FIGS. 50A and 50B) similar to how pin contacts 20 are inserted into sheath 25B. One difference is that no portion of socket contacts 190 protrudes from sheath 25A or from sheath 25C in preferred embodiments. Another difference is that collar pockets 325A (FIG. 51) of sheath 25A (and of sheath 25C) are each deep enough to contain a socket portion 430 of a socket contact 190 as well as a collar 435 (FIG. 55) of socket contact 190. Cover 30 is also slid into place and locked in place substantially as described above with respect to sheath 25, and cantilever beam top 30C functions in a manner substantially as described above with respect to sheath 25B.

Sheaths 25A (or sheaths 25C) containing wires terminated with socket contacts 190 are loaded into cavities 195 of socket front shell 200 (FIG. 48), and an optional electrically conductive shield 130 and optional rear shell 170 are attached to socket front shell 200 substantially similar to how they are attached to pin front shell 40 described above. Likewise, rear seal 110 is slid into place over rear shell 170 and a portion of socket front shell 200.

Connecting a Pin Connector to a Socket Connector

An assembled pin connector 10 is connected to an assembled socket connector 15, for example, to connect two ends of two cables together or to connect an end of a cable to an electronic device.

Figure 8:
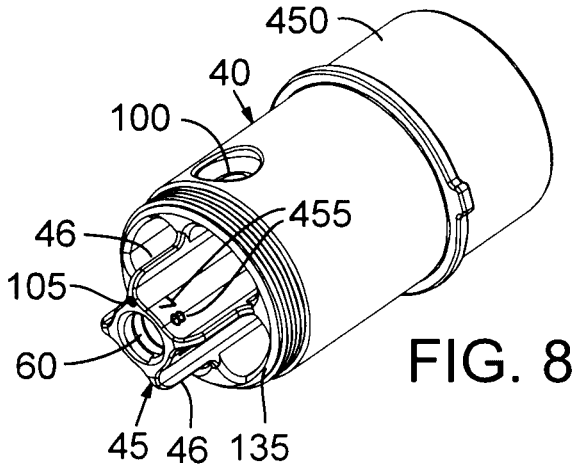
FIG. 8 is a right rear isometric view of the pin front shell of FIG. 5.
Figure 6:
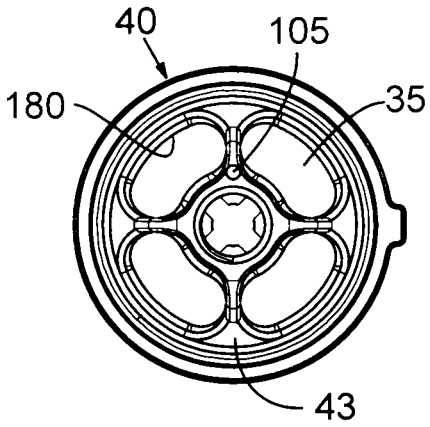
FIG. 6 is a front view of the pin front shell of FIG. 5.
Figure 47:
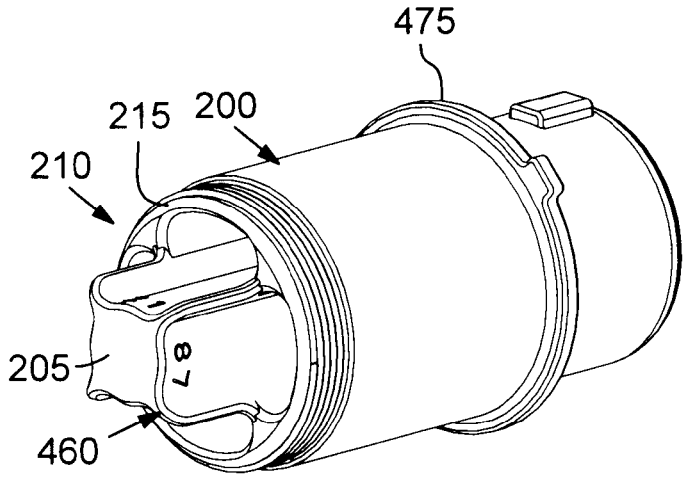
FIG. 47 is a left-side rear isometric view of the conductive socket front shell of FIG. 41.

With reference to FIGS. 2, 12, 31, and 33, when pin connector 10 is brought into contact with socket connector 15, a first alignment feature 440 (FIG. 7) on pin front shell 40 engages a second alignment feature 445 (FIG. 40) on socket front shell 200. In the embodiment illustrated in FIG. 2, the first alignment feature 440 is a groove formed in an internal surface of shroud 450 of pin front shell 40 and the second alignment feature 445 is a projection formed on an external surface of socket front shell 200. Other suitable alignment features may be used. One purpose of using alignment features 440 and 445 is to properly match twisted pairs between two cables, or between a cable and an electronic device. As illustrated in FIG. 8, post 45 includes indicia 455 indicating that a particular pair of wires, for example, wires #7 and #8, should be inserted into a particular cavity 35, and the order for the pair of wires, i.e., wire #7 on the left and wire #8 on the right side of cavity 35. Likewise, indicia 460 (FIG. 47) are included on post 205. Note that the indicia 460 mirror the indicia 455 so that the same wire is electrically connected once pin connector 10 and socket connector 15 are joined. In other words, wire #7 from a first cable electrically connects to wire #7 of a second cable, wire #8 of the first cable electrically connects to wire #8 of the second cable, and so on, for a straight, or patch type connection. Other suitable wire matching or pairing schemes may be used.

When alignment features 440 and 445 engage, the insertion plug 231 (FIG. 10) of pin front shell 40 is also received in a connecting bore (locking bore 465) (FIG. 48) formed in socket front shell 200 of socket connector 15. As pin connector 10 and socket connector 15 are slidably moved together and mated, cantilever beams 230 are deflected toward central axis 175 by snap-lock ridge 245 bearing against a conductive inner wall surface of locking bore 465. Such movement of cantilever beams 230 causes connecting post 65 to move toward the rear 50 (FIG. 4) of pin front shell 40, thus overcoming the force exerted by spring 70.

Pin connector 10 and socket connector 15 are brought together until a front edge 470 (FIG. 5) of pin front shell 40 contacts annular ring (flange) 475 (FIG. 40) on socket front shell 200 and snap-lock ridge 245 (FIG. 10) moves past shoulder 480 (FIG. 44) created by inner circumferential groove 485 formed in the internal wall of locking bore 465 in socket front shell 200. When snap-lock ridge 245 moves past shoulder 480, spring 70 urges connecting post 65 toward the front end 80 of locking bore 60, which causes cantilever beams 230 to move away from central axis 175. Snap-lock ridges 245 thus sit behind shoulder 480 and engage shoulder 480 which to latch or lock pin connector 10 and socket connector 15 together, for example, as illustrated in FIG. 2.

Preferably, engagement of snap-lock ridge 245 with shoulder 480 provides a solid mechanical connection and electrical connection between pin connector 10 and socket connector 15, even when the joined pin connector 10 and socket connector 15 are subjected to mechanical vibrations and stresses, such as mechanical and thermal stresses. Maintaining a solid mechanical and electrical connection between pin connector 10 and socket connector 15 preferably facilitates shielding against external electromagnetic interference that may otherwise interfere with the cables terminated by the pin connector 10 and socket connector 15.

Shields 130 made from an electrically conductive material and placed over portions of the sheaths 25 and 25A cooperate with cavities 35 and 195 to substantially electrically isolate each sheath 25 and 25A, and the contacts contained within such sheaths. The electrically conductive rear shells 170 also contributes to such electrical isolation. Lips 180 and 225 of cavities 35 and 195, respectively, provide electrically conductive material proximate and overlapping portions of the front ends of sheaths 25 and 25A such that when pin connector 10 mates with socket connector 15 there is no substantial gap in electrical shielding surrounding the interface between pin contacts 20 and socket contacts 190. Preferably, a gap between lips 190 and respective lips 225 is approximately 0.010 inch or less. Therefore, noise emitted by a pair of pin or socket contacts substantially flows to a conductive path to ground instead of to another pair of pin or socket contacts, or to another cable.

Forming an environmental seal between pin connector 10 and socket connector 15 is facilitated by placing facial seal 115 in an internal groove 120 (FIG. 10) of pin front shell 40. The facial seal 115 is compressed into grove 120 by the front of socket front shell 200 when pin connector 10 and socket connector 15 mate together. Facial seal 115 functions to hinder moisture, dust, or other contaminants from entering pin connector 10 and socket connector 15. Preferably, nearly pure compression forces are imparted to facial seal 115 because pin connector 10 and socket connector 15 are linearly joined together, that is, neither pin connector 10 or socket connector 15 is twisted or rotated when they are joined. Such linear compression without substantial torsion preferably provides controlled, predictable compression and expansion of facial seal 115 as well as helps prevent tearing or otherwise breaking down the material of facial seal 115.

Facial seal 115 and sealing release button 90 (or using a sealed release button, such as 90A (FIG. 3A)) preferably provide electrical connectors that inhibit moisture, dust, or other contaminants from entering independently of a separate housing. An optional seal similar to facial seal 115, but located between a front shell (40 or 200, for example) and a rear shell (170, for example) may be included to further inhibit moisture, dust, or other contaminants from entering a pin connector (10, for example) or a socket connector (15, for example). In other words, relatively small, lightweight, and simple housings may be used to hold pin and socket connectors 10 and 15 without the need for such housings to hinder moisture, dust, or other contaminants from entering the electrical connectors 10 and 15. In contrast, commonly available electrical connectors typically rely on a housing to inhibit moisture, dust, and other contaminant intrusion.

Separating a Pin Contact from a Socket Contact

With reference to FIGS. 2, 12, 31, and 33, when release button 90 is depressed, surface 270 of release button 90 engages front facing surface 290 of connecting post 65 to move connecting post 65 toward spring 70. When connecting post 65 moves away from the front end 80 of locking bore 60, the inherent spring force in cantilever beams 230 causes each cantilever beam 230 to deflect toward central axis 175 of pin connector 10. Thus, snap-lock ridges 245 disengage from shoulder 480, which permits connecting post 65 to be withdrawn from locking bore 465 of socket connector 15. Thus, depressing release button 90 allows pin connector 10 and socket connector 15 to be separated from each other.

Electrical Connector Housings

Exemplary housings 500 and 505 are illustrated in FIGS. 57-64. Housing 500 holds two pin connectors 10 and housing 505 hold two socket connectors 15. However, it is not important which housing, 500 or 505, holds pin connectors 10 or socket connectors 15. Two panel mounting devices 510 may be included on each of housings 500 and 505. Panel mounting devices are described in detail in co-pending U.S. Patent Application No. 61/420,480, filed on Dec. 7, 2010, for "Panel Mounting Device And Method of Use,", which is fully incorporated by reference herein.

Figure 60:
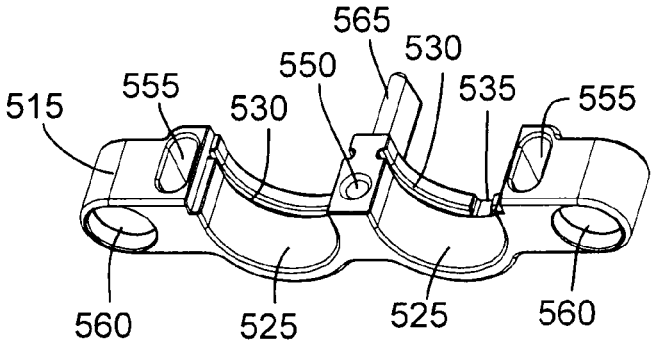
FIG. 60 illustrates a bottom isometric view of the first housing first portion of FIG. 57.
Figure 63:
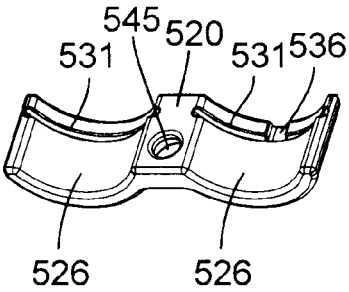
FIG. 63 illustrates a top isometric view of the first and second housing second portion of FIG. 57.

As best illustrated in FIGS. 60 and 63, housing 500 includes a first portion 515 and a second portion 520. First portion 515 includes two U-shaped seats 525 for receiving pin connectors 10. Pin connectors 10 are inserted through the open section of the U-shape such that ring (flange) 490 (FIG. 7) of pin front shell 40 is received in groove 530. For a first pin connector 10, a protrusion 492 on ring 490 is aligned with slot 535 of first housing portion 515 to orient the first pin connector 10 with respect to the housing 500.

Figure 64:
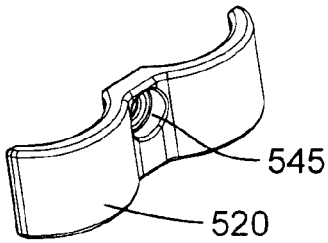
FIG. 64 illustrates bottom isometric view of the first and second housing second portion of FIG. 57.
Figure 65:
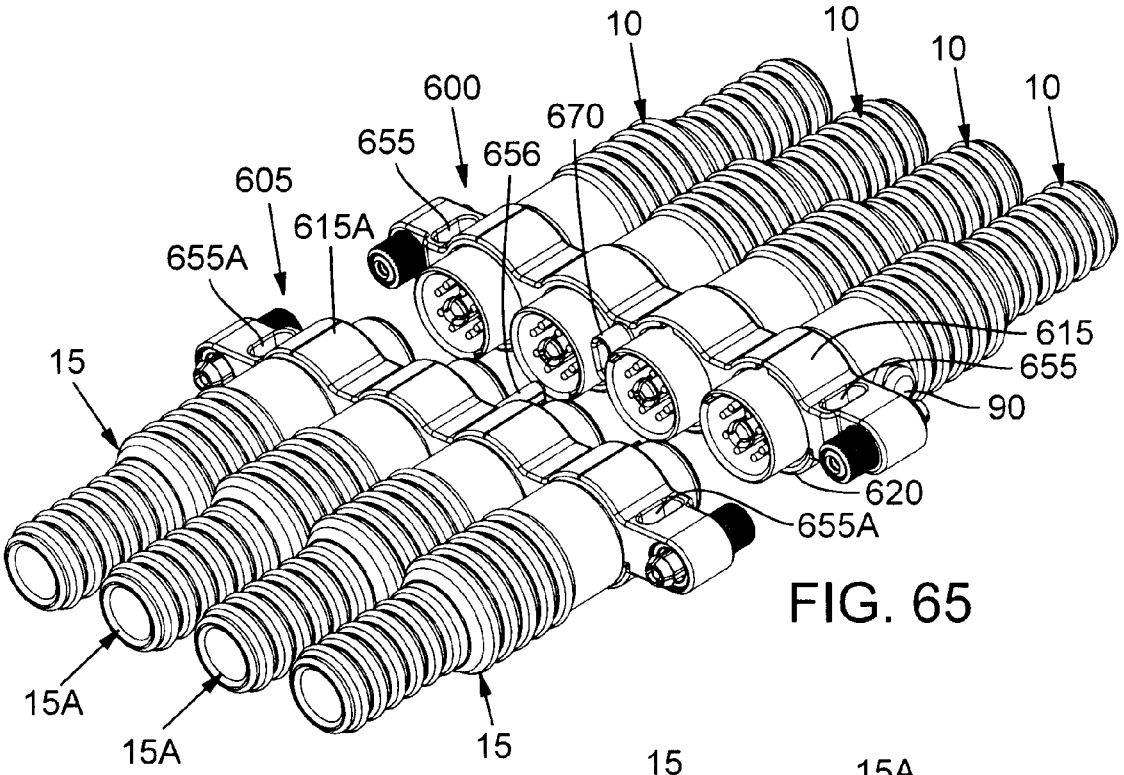
FIG. 65 illustrates a right-side, top, rear isometric view of another first housing holding electrical connectors and a left-side, top, front isometric view of another second housing holding electrical connectors.
Figure 66:
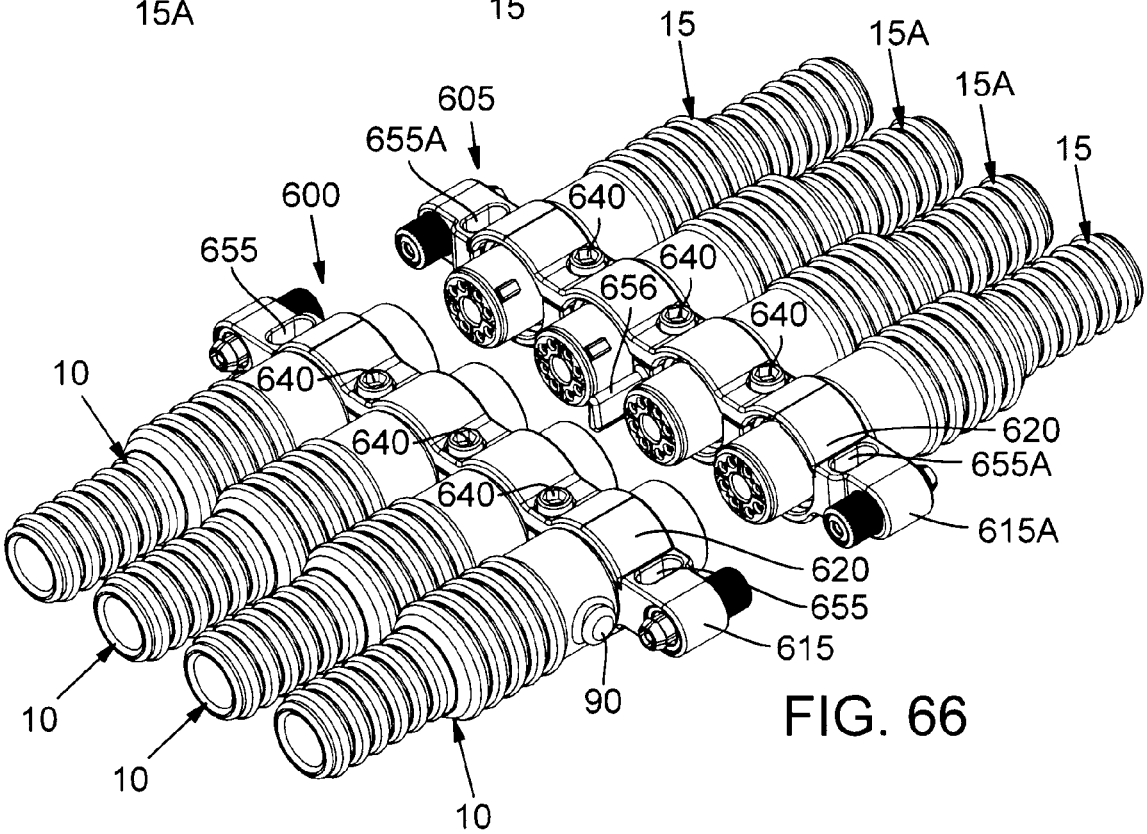
FIG. 66 illustrates a left-side, bottom, front isometric view of the first housing holding electrical connectors and a right-side, bottom, rear isometric view of the second housing holding electrical connectors of FIG. 65.
Figure 67:
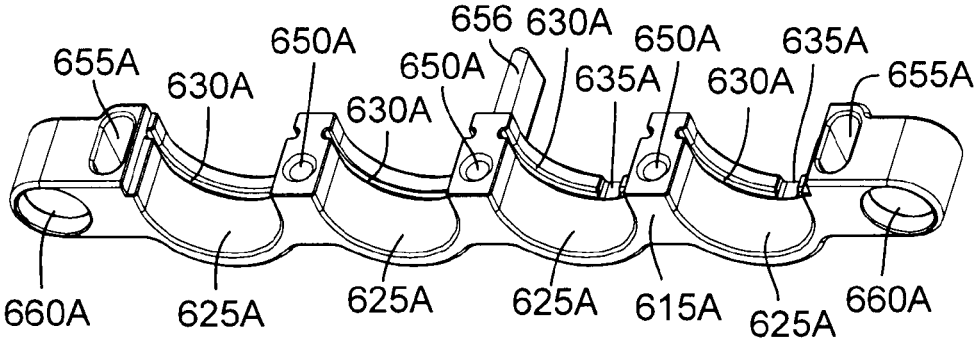
FIG. 67 illustrates a bottom isometric view of the first housing first portion of FIG. 65.
Figure 68:
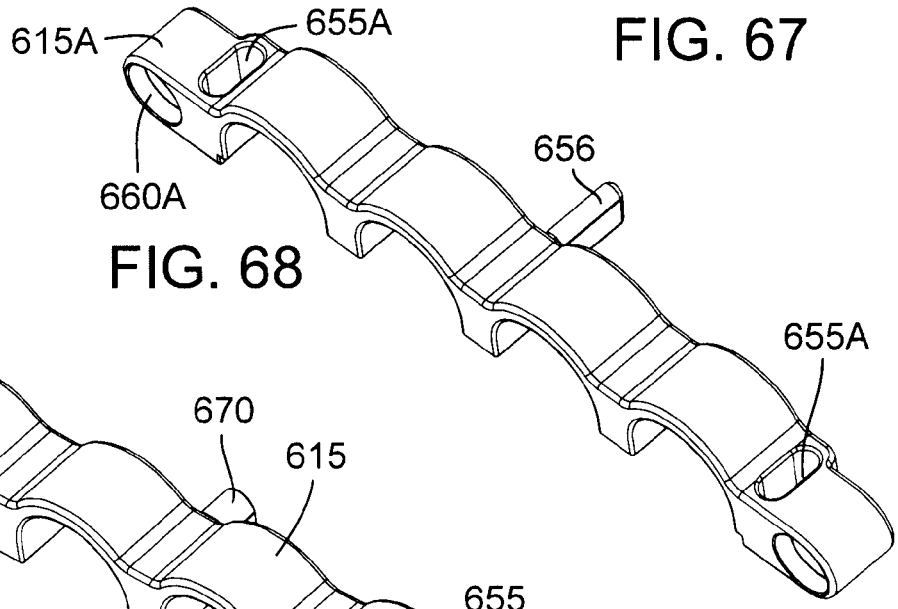
FIG. 68 illustrates a right-side, top, rear isometric view of the first housing first portion of FIG. 65.
Figure 70:
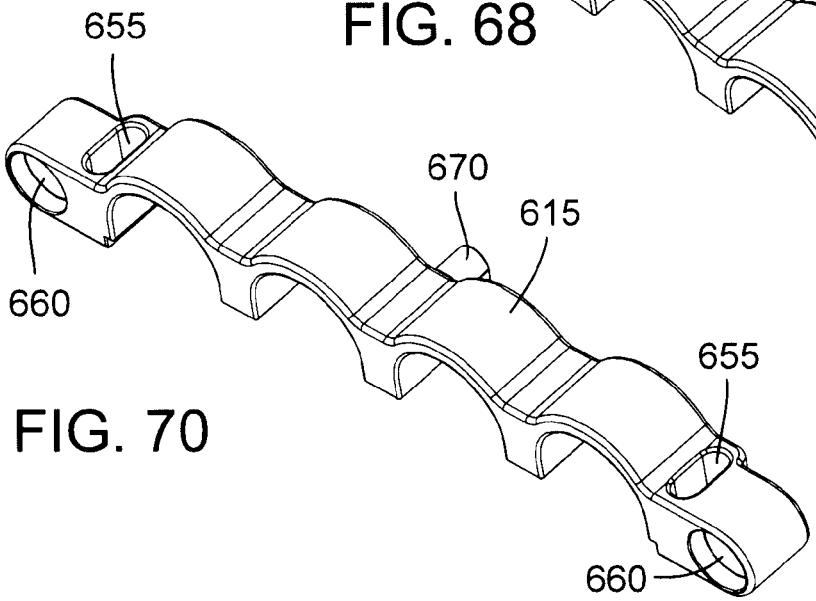
FIG. 70 illustrates a right-side, top, rear isometric view of the second housing first portion of FIG. 65.
Figure 69:
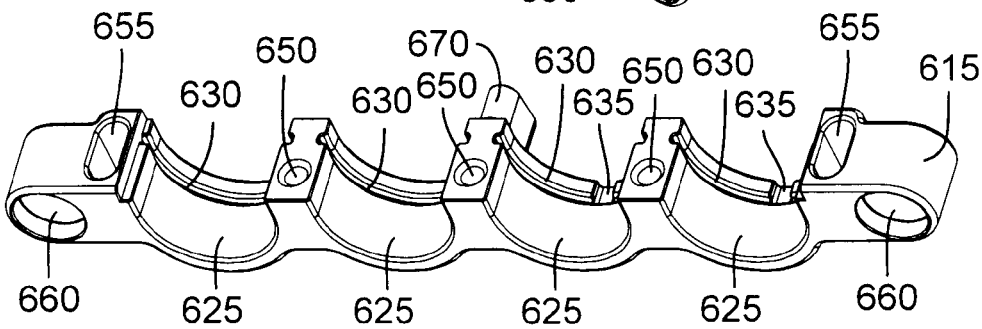
FIG. 69 illustrates a bottom isometric view of the second housing first portion of FIG. 65.
Figure 71:
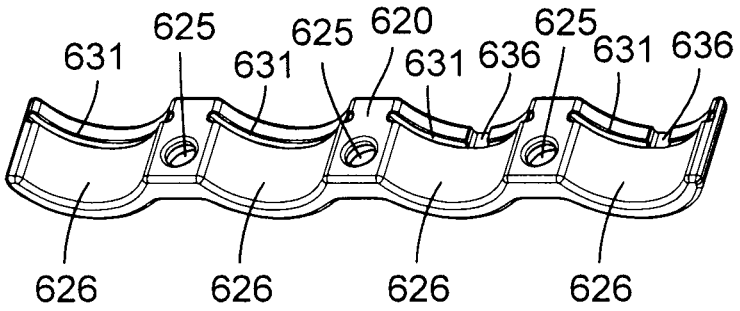
FIG. 71 illustrates a top isometric view of the first and second housing second portion of FIG. 65.
Figure 72:
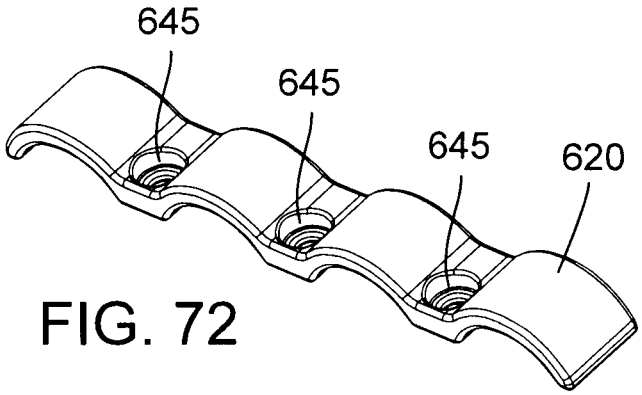
FIG. 72 illustrates bottom isometric view of the first and second housing second portion of FIG. 65.

With reference to FIGS. 63 and 64, second housing portion 520 includes two U-shaped seats 526 for receiving pin connectors 10. In a preferred arrangement, U-shaped seats 526 are approximately ⅓ the depth of U-shaped seats 525 of first housing portion 515. Second portion 520 is dropped over pin connectors 10 so that rings 490 of each pin connector 10 are received in grooves 531. For the second pin connector 10, a protrusion 492 on ring 490 is aligned with slot 536 to orient the second pin connector 10 with respect to the housing 500.

In a preferred arrangement, a gap of approximately 0.010 inch exists between first portion 515 and second portion 520 when pin connectors 10 are contained therebetween. A fastener, such as a screw 540 (FIG. 58), is inserted through aperture 545 in the second portion 520 and into threaded aperture 550 in the first portion 515. Tightening screw 540 compresses first and second housing portions 515 and 520 together to retain pin connectors 10 in place. Preferably, housing portions 515 and 520 do not touch each other when screw 540 is fully tightened, for example, a gap of approximately 0.005 inch exists between housing portions 515 and 520 in one arrangement.

Figure 57:
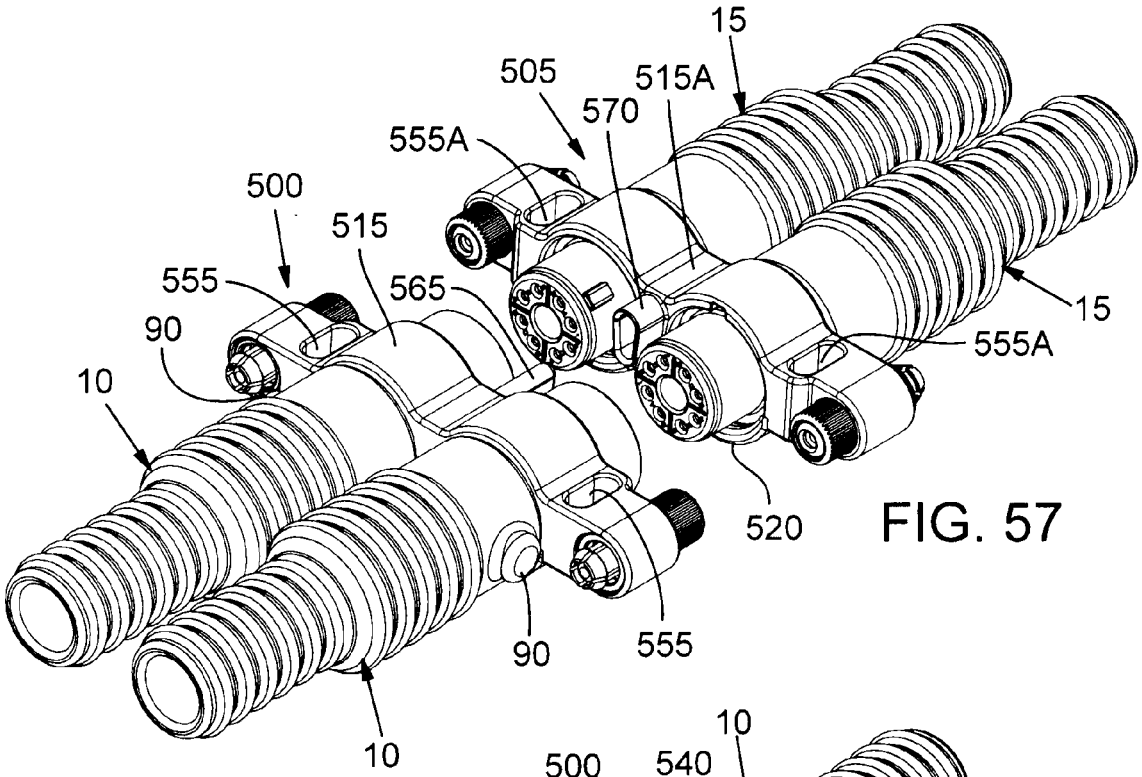
FIG. 57 is an isometric view of first and second housings (yokes) each holding a pair of electrical connectors.
Figure 58:
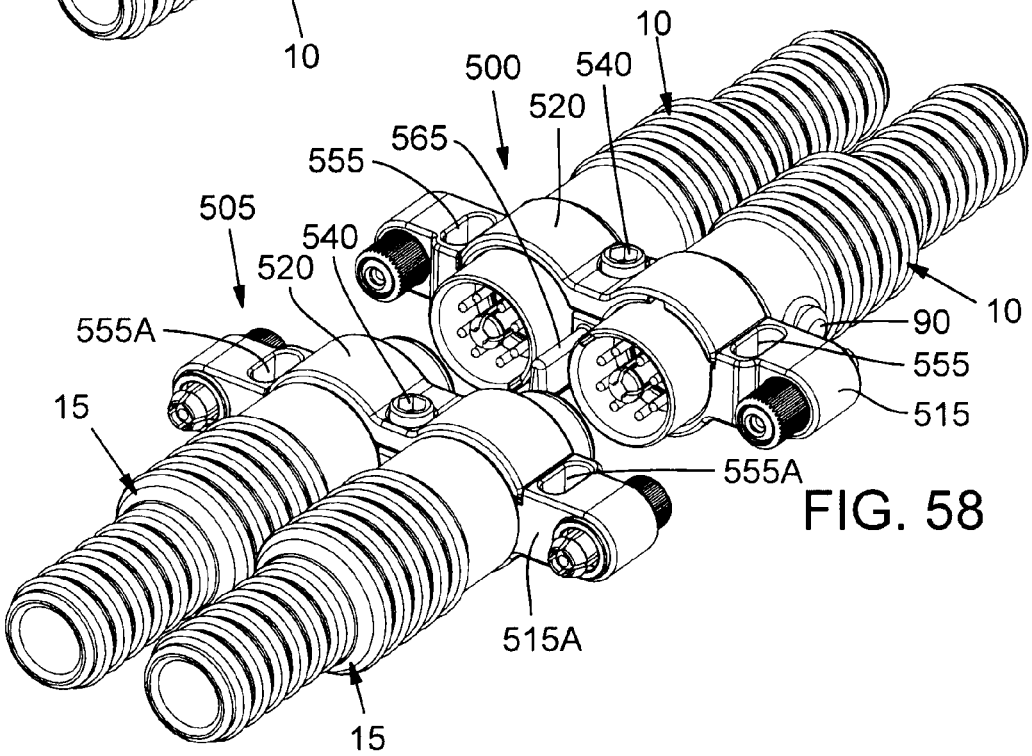
FIG. 58 illustrates a left-side, bottom, front isometric view of the first housing holding electrical connectors and a right-side, bottom, rear isometric view of the second housing holding electrical connectors of FIG. 57.
Figure 59:
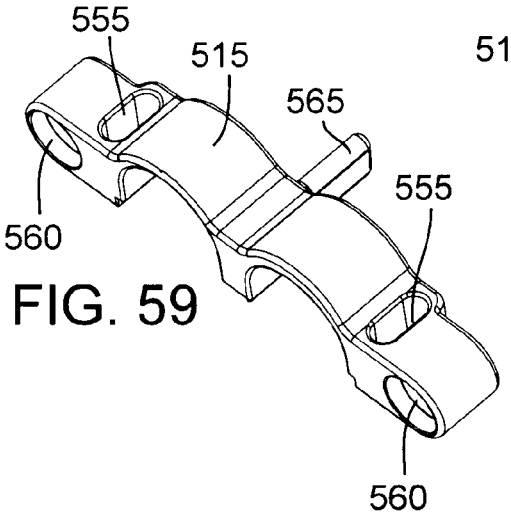
FIG. 59 illustrates a right-side, top, rear isometric view of the first housing first portion of FIG. 57.

As best illustrated in FIG. 57, a preferred arrangement includes each pin connector 10 with its release button 90 facing away from the other pin connector 10. Such an arrangement allows a user to activate both release buttons 90 with one hand to thereby facilitate separating pin connectors 10 from socket connectors 15 as the user's other hand is free to grasp socket connectors 15 or the housing 505 holding them.

Housing portions 515 and 520 are preferably made from a rigid material, such as T6-7075 aluminum, other metal, or a plastic, which may be plated with nickel, silver, or gold. One advantage from constructing housing portions 515 and 520 from an electrically conductive material is to create an electrical path from a pin front shell 40 through a housing 500 to ground extra space when housing 500 contacts a grounding surface, such as an electrically conducting interior structure of an aircraft. Each pin front shell 40 substantially surrounds pin contacts 20, and is preferably electrically connected to a shield surrounding twisted pairs of a cable. Therefore, providing an electrical path between pin front shell 40 and housing 500 provides a low resistance path to ground for unwanted electric signals in the cable, at the pin contacts 20, or externally generated and directed toward the cable shield or the pin connector 10.

Housing 500 optionally includes anchor apertures 555, panel mounting device apertures 560, or both. Anchor apertures 555 are preferably sized and dimensioned to receive one or more of various fasteners such as screws, wire ties, or other suitable fasteners for securing housing 500 to a structure. Panel mounting device apertures 560 are sized and dimensioned to receive panel mounting devices, such as panel mounting devices described in co-pending U.S. patent application Ser. No. 61/420,480, but may be sized and dimensioned to receive one or more of various fasteners such as screws, wire ties, or other suitable fasteners for securing housing 500 to a structure. Housing 500 also preferably includes a first portion 565 of an alignment device used to orient housing 500 with respect to housing 505.

Figure 61:
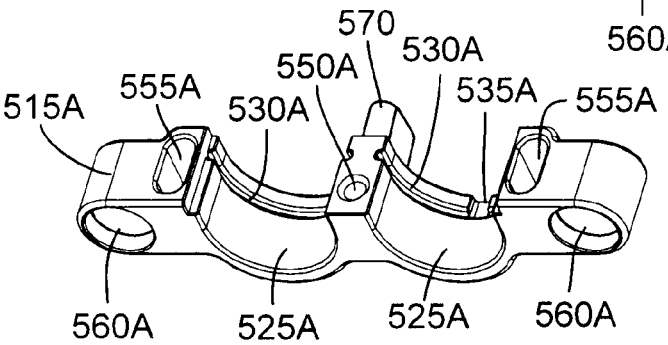
FIG. 61 illustrates a bottom isometric view of the second housing first portion of FIG. 57.
Figure 62:
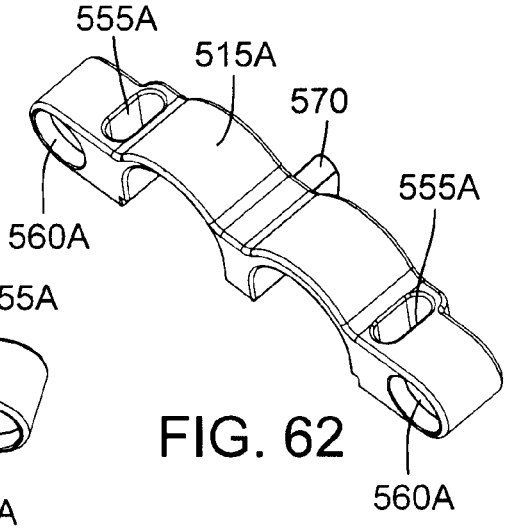
FIG. 62 illustrates a right-side, top, rear isometric view of the second housing first portion of FIG. 57.

With reference to FIGS. 61 and 62, housing 505 is substantially similar to housing 500. For example, in a preferred embodiment both housing 500 and housing 505 use the same housing portion 520 to retain pin connectors 10 or socket connectors 15. One difference between housing 500 and housing 505 is that housing 505 includes a first portion 515A that bears a second portion 570 of the alignment device instead of the first portion 565. Like first portion 515, first portion 515A is configured to orient and secure socket connectors 15 (or pin connectors 10) in conjunction with second portion 520.

In the embodiment illustrated in FIG. 57, first portion 565 of the alignment device is a shaped cantilever post extending from first housing portion 515. Second portion 570 of the alignment device is a shaped socket secured to first housing portion 515A. Because of the shape of the cantilever post and of the shaped socket, housings 500 and 505 can only be brought close enough together for pin contacts 20 to engage socket contacts 190 when housing 500 and housing 505 are in a desired orientation with respect to each other. Such orientation control helps facilitate matching the correct wire pairs between pin connectors 10 and socket connectors 20. Otherwise, it would be possible for either housing 500 or housing 505 to be mis-oriented by 180° which would result in multiple wire pair mismatches. In a preferred embodiment, first and second alignment portions 565 and 570 contact and engage each other before pin contacts 20 engage socket contacts 190 to pre-align the pin contacts 20 with the socket contacts 190. Such pre-alignment preferably helps reduce bending or otherwise damaging the pin contacts 20 and the socket contacts 190 when pin connectors 10 and socket connectors 15 are mated together.

Other suitable alignment devices may be used, for example, instead of a single cantilever post two or more posts in a unique arrangement, or two or more posts having different sizes or shapes could be used with corresponding sockets or apertures.

FIGS. 65-72 illustrate another housing combination. Housings 600 and 605 are similar to housings 500 and 505 but include four U-shaped seats 625, 625A, and 626. In a preferred arrangement, two modified socket connectors 15A are used with housings 600 and 605. Socket connectors 15, as described above, are located in the two outer sets of U-shaped seats 625 or 625A. The two modified socket connectors 15A are located in the two central sets of U-shaped seats 625 or 625A.

Figure 46:
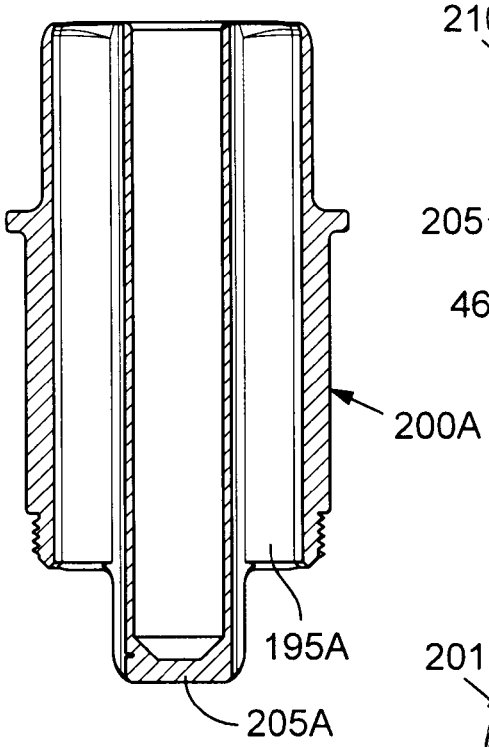
FIG. 46 is a cross-sectional view of another embodiment of a conductive socket front shell.

The modification to socket connectors 15A includes eliminating the annular inner circumferential groove 485 (FIG. 44) formed in the internal wall of locking bore 465 of socket connector 15. In other words, locking bores 456A (FIG. 46) have a smooth internal wall. Without a shoulder 480 (FIG. 44) in the locking bores 456A (FIG. 46) there is no corresponding snap-lock feature to engage the snap-lock ridges 245 (FIG. 10) of corresponding pin connectors 10. Therefore, pin connectors 10 do not lock into place when mated to modified socket connectors 15A.

In another embodiment (FIG. 10A), socket connectors 15 may be used with a pin connector 10B that includes a connecting post 65B bearing a protective cap 66. Cantilever beams 230B have a modified snap-lock feature 245B that includes a rounded surface 232 instead of a planar, or substantially planar, surface such as those of snap-lock features 245 (FIG. 12). Pin connectors 10B may be used in internal positions, such as the two central positions illustrated in FIG. 65, while pin connectors 10 are used in external positions, or four pin connectors 10B may be used (of which the outer two preferably include release buttons such as 90 or 90A).

The rounded surface 232 of modified snap-lock features 245B provides sufficient interference with the annular groove 485 of socket connectors 15 to inhibit socket connectors 15 from becoming inadvertently disengaged from pin connectors 10B. But, such rounded surfaces do not prevent socket connectors 15 from becoming disengaged from pin connectors 10B when a suitable pulling force is exerted against both socket connectors 15 and pin connectors 10B, even when release buttons 90 or 90A are not depressed. Pin connectors 10B therefore may, or may not, include release buttons such as release buttons 90 or 90A.

Protective cap 66 serves as a guide to facilitate inserting connecting post 65B into locking bores 465 and also inhibits cantilever beams 230B from catching on an edge of the entrance to locking bores 465 or otherwise becoming bent. Pin connectors, such as pin connectors 10, may include protective caps, such as protective caps 66.

By orienting the outer pin connectors 10 to have their release buttons 90 facing away from their neighboring pin connectors 10, housings 600 and 605 facilitate a user activating both release buttons 90 with one hand. Because the modified socket connectors 15A do not lock with their corresponding pin connectors 10 (or, because pin connectors 10B do not fully lock with their corresponding socket connectors 15), a user may grasp with one hand the socket connectors 15, 15A, or both, or the housing 600 or 605 holding such connectors, and with the user's other hand depress the outer two release buttons 90 to separate the pin connectors 10, 10B, or both from the socket connectors 15, 15A, or both.

In other embodiments, a housing 500, 505, 600, or 605 may include a ridge or lip that snaps over rings 490 to secure pin connectors 10 with socket connectors 15, 15A, or both. In such embodiments, pin connectors 10 may be modified to eliminate the locking mechanism 55 and the release mechanism 85, and cantilever beams 230 may be eliminated or replaced with a solid post, or pin connectors 10B may be used.

Figure 73:
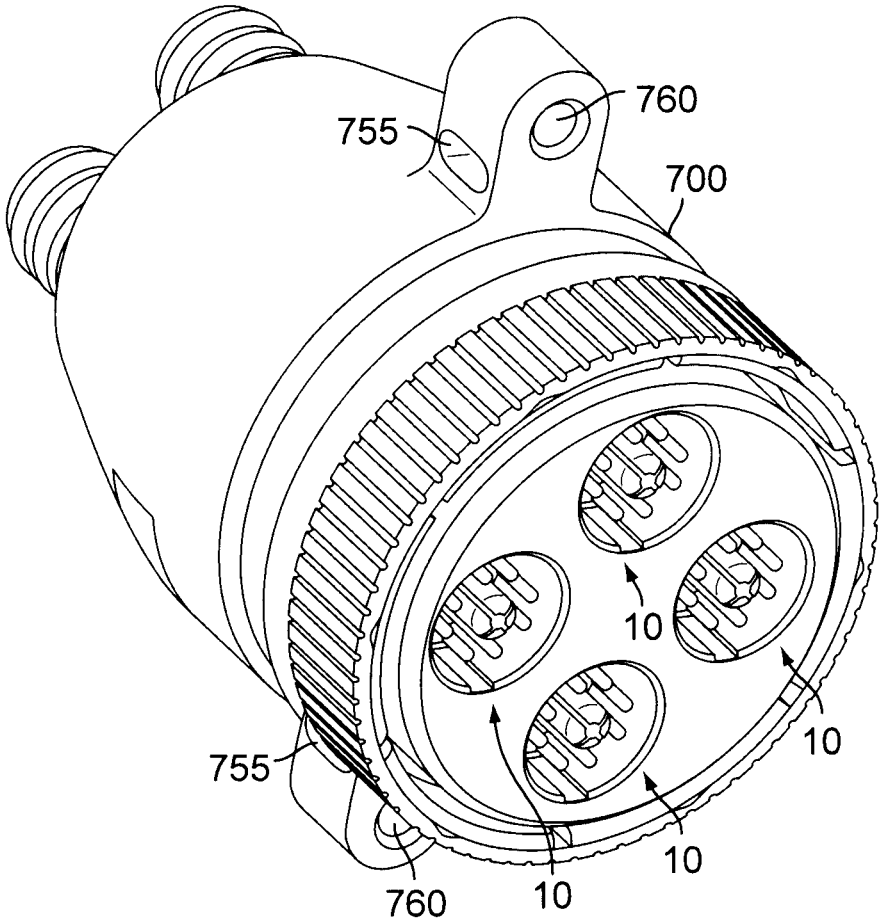
FIG. 73 illustrates a front isometric view of another housing.
Figure 74:
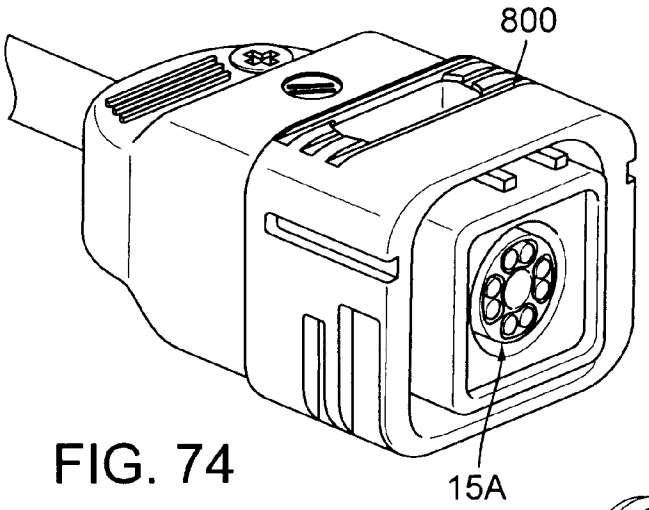
FIG. 74 illustrates a right-side isometric view of another housing.
Figure 75:
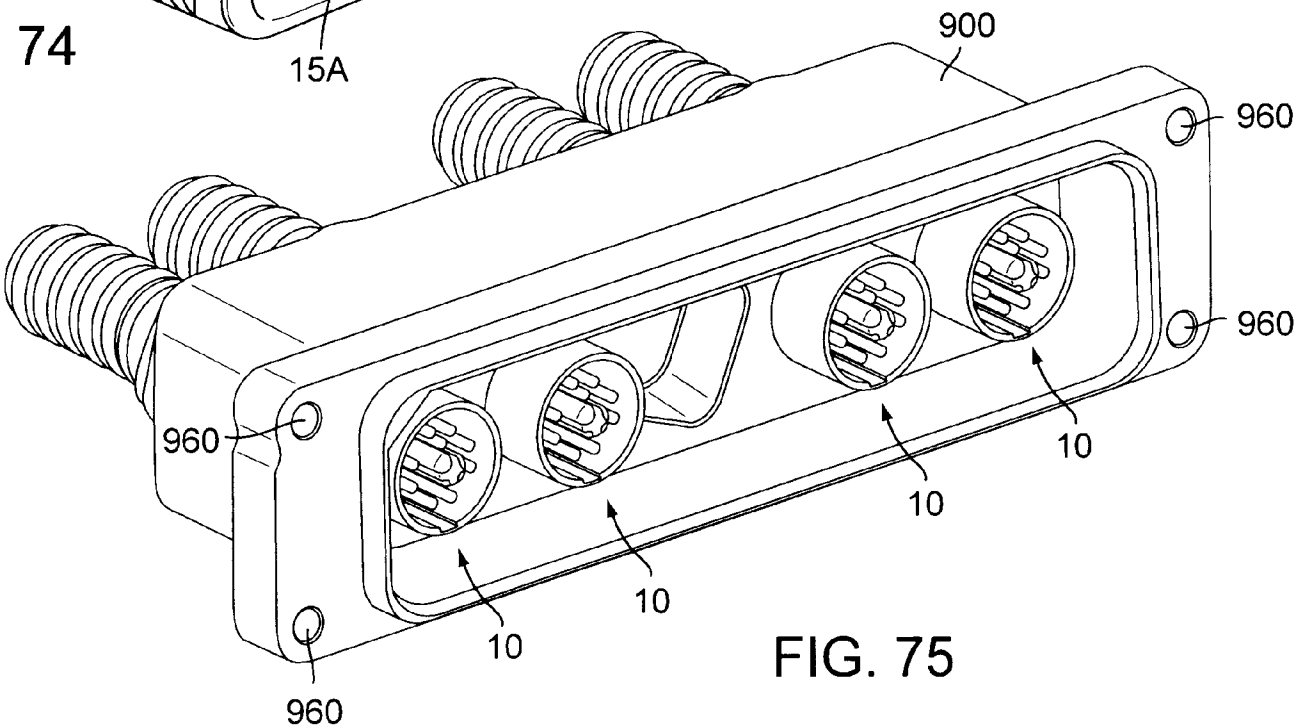
FIG. 75 illustrates a right-side isometric view of another housing.

As illustrated in FIGS. 73-75, pin connectors 10, 10B, or both and socket connectors 15, 15A, or both may be contained in various housing arrangements. Modified socket connectors 15A, or pin connectors 10B, are preferably used when access to release buttons 90 on pin connectors 10 is hindered by a housing, such as a housing 700, 800, or 900 (FIGS. 73-75).

It will be obvious to those having skill in the art that many changes may be made to the details of the above-described embodiments without departing from the underlying principles of the invention.

The invention claimed is:

1. A connector system, comprising:

an electrical connector having an electrically conductive front shell defining a plurality of contact-receiving cavities extending in an axial direction, each of the cavities having an opening at a front face of the front shell, the front shell including an electrically conductive insertion plug projecting from the front face in the axial direction from a location on the front face between the openings, the insertion plug having a plurality of cantilever members each including a radially outwardly projecting portion located proximate a free end of the cantilever member, and a mating connector that is configured to be mated to the electrical connector by sliding the electrical connector and mating connector together along the axial direction, the mating connector having a conductive front shell defining a connection bore sized to receive the insertion plug so that at least one of the radially outwardly projecting portions of the cantilever members of the insertion plug bears upon a conductive inner surface of the connection bore when the electrical connector and mating connector are mated, to thereby establish a low impedance connection between the front shell of the electrical connector and the front shell of the mating connector.

2. The connector system of claim 1, wherein the inner surface of the connection bore includes an inner circumferential groove having a shoulder proximate a front face of the mating connector, the circumferential groove sized to receive the radially outwardly projecting portions behind the shoulder to latch the electrical connector and mating connector together.

3. An electrical connector, comprising:

an electrically conductive front shell defining a plurality of contact-receiving cavities extending in an axial direction, each of the cavities having an opening at a front face of the front shell, the front shell including an electrically conductive insertion plug projecting from the front face in the axial direction from a location on the front face between the openings, the insertion plug having a plurality of cantilever members each including a radially outwardly projecting portion located proximate a free end of the cantilever member, wherein the insertion plug and the cantilever members are integrally formed with the front face of the front shell of a conductive material.

4. The connector of claim 3, wherein:

the front shell includes a conductive central core extending in the axial direction and a plurality of conductive fins radiating from the core and interconnecting the core with a peripheral portion of the front shell, each of the fins separating and shielding adjacent ones of the cavities from each other, and the peripheral portion, the core, the fins, the front face, the insertion plug, and the cantilever members are all integrally formed in a monolithic structure.

5. The connector system of claim 1, wherein:

the front shell includes a conductive central core extending in the axial direction and a plurality of conductive fins radiating from the core and interconnecting the core with a peripheral portion of the front shell, each of the fins separating and shielding adjacent ones of the cavities from each other, and the peripheral portion, the core, the fins, the front face, the insertion plug, and the cantilever members are all integrally formed in a monolithic structure.

6. The connector system of claim 1, wherein the conductive front shell of the electrical connector includes a conductive central core extending in the axial direction, the electrical connector further comprising:

an axial bore extending through the core and into the insertion plug; and a connecting post slidably received in the axial bore, the connecting post slidable between a first position in which a portion of the post extends forward of the front face between the cantilever members and bears against the cantilever members to urge the free ends of the cantilever members radially outward, and a second position allowing the free ends of the cantilever members to return to a radially inward position relative to the first position, to thereby facilitate insertion of the insertion plug into the connection bore of the mating connector and subsequent decoupling of the electrical connector and mating connector.

7. The connector system of claim 6, further comprising a latch release button retained in the front shell of the electrical connector, the latch release button being manually depressible to drive the connecting post toward the second position to facilitate decoupling of the electrical connector and mating connector.

8. The connector system of claim 1, further comprising a latch release button that is manually depressible to disengage the cantilever members of the electrical connector from the conductive inner surface of the connection bore of the mating connector to thereby facilitate decoupling of the electrical connector and mating connector.

9. The electrical connector of claim 3, further comprising a plurality of electrically insulating sheaths, each sheath sized to receive and retain a pair of wire-terminating electrical contacts in spaced-apart relation such that at least a portion of each electrical contact is contained within the sheath in alignment with one of a pair of contact apertures in a front wall of the sheath and each of a pair of wires terminated by the electrical contacts extends through a rear end portion of the sheath, each sheath sized and shaped for insertion into one of the plurality of contact-receiving cavities so as to position the contact apertures of the sheath in alignment with the front opening of said cavity.

10. An electrical connector, comprising:

an electrically conductive front shell defining a plurality of contact-receiving cavities extending in an axial direction, each of the cavities having an opening at a front face of the front shell, the front shell including an electrically conductive insertion plug projecting from the front face in the axial direction from a location on the front face between the openings, the insertion plug having a plurality of cantilever members each including a radially outwardly projecting portion located proximate a free end of the cantilever member, wherein the front shell includes a conductive central core extending in the axial direction and a plurality of conductive fins radiating from the core and interconnecting the core with a peripheral portion of the front shell;

an axial bore extending through the core and into the insertion plug; and a connecting post slidably received in the bore, the connecting post slidable between a first position in which a portion of the post extends forward of the front face between the cantilever members and bears against the cantilever members to urge the free ends of the cantilever members radially outward, and a second position allowing the free ends of the cantilever members to return to a radially inward position relative to the first position, to thereby facilitate insertion of the insertion plug into a connection bore of a mating connector and subsequent decoupling of the electrical connector and mating connector.

11. The connector of claim 10, wherein the peripheral portion, the core, the fins, the front face, the insertion plug, and the cantilever members are all integrally formed in a monolithic structure.

12. The connector of claim 10, further comprising a spring operably interposed between the core and the connecting post for biasing the connecting post forwardly relative to the front shell.

13. The connector of claim 10, further comprising a latch release button retained in the front shell that is manually depressible to drive the connecting post toward the second position.

14. An electrical connector, comprising:

an electrically conductive front shell defining a plurality of contact-receiving cavities extending in an axial direction, each of the cavities having an opening at a front face of the front shell, the front shell including an electrically conductive insertion plug projecting from the front face in the axial direction from a location on the front face between the openings, the insertion plug having a plurality of cantilever members each including a radially outwardly projecting portion located proximate a free end of the cantilever member, wherein each of the cavities extends entirely through the front shell, each of the cavities having a rear opening proximate a rear end of the front shell and opposite the front opening, and further comprising:

a plurality of electrically insulating sheaths, each sheath sized to receive and retain a pair of wire-terminating electrical contacts in spaced-apart relation such that at least a portion of each electrical contact is contained within the sheath in alignment with one of a pair of contact apertures in a front wall of the sheath and each of a pair of wires terminated by the electrical contacts extends through a rear end portion of the sheath, each sheath sized and shaped for insertion into one of the cavities so as to position the contact apertures of the sheath in alignment with the front opening of said cavity; and an electrically conductive rear shell adapted to be coupled to the front shell and extending rearwardly of the rear end thereof so as to capture the sheaths between the front and rear shells, the rear shell including a rear opening for admitting the plurality of pairs of wires therethrough.

15. The electrical connector of claim 14, wherein the insertion plug and the cantilever members are integrally formed with the front face of the front shell of a conductive material.

16. The electrical connector of claim 14, further comprising a latch release button that is manually depressible to disengage the cantilever members of the electrical connector from a catch of a mating connector to thereby facilitate decoupling of the electrical connector and mating connector.

17. A connector system including the connector of claim 14, and further comprising a mating connector that is configured to be mated to the electrical connector by sliding the electrical connector and mating connector together along the axial direction, the mating connector having a conductive front shell defining a connection bore sized to receive the insertion plug so that at least one of the radially outwardly projecting portions of the cantilever members of the insertion plug bears upon a conductive inner surface of the connection bore when the electrical connector and mating connector are mated, to thereby establish a low impedance connection between the front shell of the electrical connector and the front shell of the mating connector.

18. The electrical connector of claim 14, further comprising:

an electrically conductive annular shield separate from the front shell and the rear shell and captured therebetween so as to abut the rear end of the front shell and surround the plurality of pairs of wires, the electrically conductive shield including a flexible rear skirt that is flexed radially inwardly by the rear shell when the rear shell is coupled to the front shell for thereby clamping around the wires.

19. The electrical connector of claim 18, further comprising a plurality of inner recesses located forwardly of the skirt for nesting the rear end portions of the sheaths therein.

20. The electrical connector of claim 14, wherein each of the cavities has a curved cross section.

21. The electrical connector of claim 20, wherein each of the cavities has a cross sectional shape of an arc segment of an annulus having curved ends, thereby resembling a kidney bean shape.

22. A connector according to claim 14, wherein the rear end portion of each sheath includes a rear opening for admitting the pair of wires into the sheath, each of the wires terminated by a wire-terminating portion of one of the pair of electrical contacts contained within the sheath.

23. A connector according to claim 14, wherein the rear end portion of each sheath includes a pair of rear openings, each of which is configured to admit one of the pair of wires into the sheath for termination by a wire-terminating portion of one of the pair of electrical contacts contained within the sheath.

24. A connector according to claim 14 adapted to hold pin contacts such that the pin contacts extend through the front openings and forwardly therefrom in the axial direction, wherein the front shell includes a shroud portion extending in the axial direction forwardly of the front openings, the sleeve portion including an annular groove formed in an internal surface of the sleeve portion; and an O-ring retained in the groove.

25. A connector according to claim 14, further comprising a latch mechanism for releasably coupling the connector to a mating connector, the latch mechanism including:

a connecting post slidably received in the core and projecting from the front face of the front shell in the axial direction; and a plurality of latch engagement members operably associated with connecting post and movable radially outward in response to sliding movement of the connecting post for engaging the mating connector.

26. The connector according to claim 25, wherein the latch mechanism includes a spring operably interposed between the core and the connecting post for biasing the connecting post forwardly relative to the front shell.

27. The connector according to claim 25, wherein the latch mechanism further includes a latch release button retained in the front shell that is manually depressible to drive the connecting post along the axial direction for releasing the latch mechanism.

28. A connector for attaching to a cable including a plurality of pairs of wires, comprising:

an electrically conductive front shell in which is formed a plurality of cavities extending in an axial direction entirely through the front shell, each of the cavities having a rear opening proximate a rear end of the front shell and an opposite front opening in a front face of the front shell, the front shell including an integral conductive central core extending in the axial direction and a plurality of conductive fins radiating from the core and integrally interconnecting the core with a peripheral portion of the front shell, each of the fins separating and shielding adjacent ones of the cavities from each other, whereby the peripheral portion, the core, and the fins are all integrally formed in a monolithic structure;

a plurality of electrically insulating sheaths, each sheath sized to receive and retain a pair of wire-terminating electrical contacts in spaced-apart relation such that at least a portion of each electrical contact is contained within the sheath in alignment with one of a pair of contact apertures in a front wall of the sheath and each of a pair of wires terminated by the electrical contacts extends through a rear end portion of the sheath, each sheath sized and shaped for insertion into one of the cavities so as to position the contact apertures of the sheath in alignment with the front opening of said cavity; and an electrically conductive rear shell adapted to be coupled to the front shell and extending rearwardly of the rear end thereof so as to capture the sheaths between the front and rear shells, the rear shell including a rear opening for admitting the plurality of pairs of wires therethrough.

29. A connector according to claim 28, further comprising:

an electrically conductive annular shield separate from the front shell and the rear shell and captured therebetween so as to abut the rear end of the front shell and surround the plurality of pairs of wires, the electrically conductive shield including a flexible rear skirt that is flexed radially inwardly by the rear shell when the rear shell is coupled to the front shell for thereby clamping around the wires.

30. A connector according to claim 29, further comprising a plurality of inner recesses located forwardly of the skirt for nesting the rear end portions of the sheaths therein.

31. A connector according to claim 28, wherein each of the cavities has a curved cross section.

32. A connector according to claim 31, wherein each of the cavities has a cross sectional shape of an arc segment of an annulus having curved ends, thereby resembling a kidney bean shape.

33. A connector according to claim 28, wherein the rear end portion of each sheath includes a rear opening for admitting the pair of wires into the sheath, each of the wires terminated by a wire-terminating portion of one of the pair of electrical contacts contained within the sheath.

34. A connector according to claim 28, wherein the rear end portion of each sheath includes a pair of rear openings, each of which is configured to admit one of the pair of wires into the sheath for termination by a wire-terminating portion of one of the pair of electrical contacts contained within the sheath.

35. A connector according to claim 28 adapted to hold pin contacts such that the pin contacts extend through the front openings and forwardly therefrom in the axial direction, wherein the front shell includes a shroud portion extending in the axial direction forwardly of the front openings, the sleeve portion including an annular groove formed in an internal surface of the sleeve portion; and an O-ring retained in the groove.

36. A connector according to claim 28, further comprising a latch mechanism for releasably coupling the connector to a mating connector, the latch mechanism including:

a connecting post slidably received in the core and projecting from the front face of the front shell in the axial direction; and a plurality of latch engagement members operably associated with connecting post and movable radially outward in response to sliding movement of the connecting post for engaging the mating connector.

37. The connector according to claim 36, wherein the latch mechanism includes a spring operably interposed between the core and the connecting post for biasing the connecting post forwardly relative to the front shell.

38. The connector according to claim 36, wherein the latch mechanism further includes a latch release button retained in the front shell that is manually depressible to drive the connecting post along the axial direction for releasing the latch mechanism.

* * * * *